United States Patent [19]

Stevens et al.

[11] Patent Number: 5,000,453

[45] Date of Patent: Mar. 19, 1991

[54] METHOD AND APPARATUS FOR AUTOMATICALLY SHUFFLING AND CUTTING CARDS AND CONVEYING SHUFFLED CARDS TO A CARD DISPENSING SHOE WHILE PERMITTING THE SIMULTANEOUS PERFORMANCE OF THE CARD DISPENSING OPERATION

[75] Inventors: Stanley Stevens, Philadelphia; Paul A. Skowronski; Edward F. Sweeney, III, both of Oreland, all of Pa.

[73] Assignee: Card-Tech, Ltd., Philadelphia, Pa.

[21] Appl. No.: 455,996

[22] Filed: Dec. 21, 1989

[51] Int. Cl.[5] ..... A63F 1/12

[52] U.S. Cl. ..... 273/149 R

[58] Field of Search ..... 273/148 A, 149 R, 149 P

[56] References Cited

U.S. PATENT DOCUMENTS

| | | | |
|---|---|---|---|
| 4,310,160 | 1/1982 | Willette et al. | 273/149 R |
| 4,513,969 | 4/1985 | Sawsel, Jr. | 273/149 R |
| 4,515,367 | 5/1985 | Howard | 273/149 R |
| 4,586,712 | 5/1986 | Lorber et al. | 273/149 R |
| 4,770,421 | 9/1988 | Hoffman | 273/149 R |
| 4,807,884 | 2/1989 | Breeding | 273/149 R |
| 4,832,342 | 5/1989 | Plevyak et al. | 273/149 R |

*Primary Examiner*—Benjamin Layno
*Assistant Examiner*—Raleigh W. Chiu
*Attorney, Agent, or Firm*—Louis Weinstein

[57] ABSTRACT

Method and appratus for automatically shuffling, cutting and delivering shuffled playing cards to a shoe without interfering with dispensing of playing cards from the shoe. The transparent covers, together with the design of the mechanism, permits observation by the players of the playing cards at all times throughout the shuffling, cutting and card delivery operations. The cards are randomly mixed by separation and subsequent merger. Cards are automatically fed to the shuffling mechanism by a drive motor. Cards are delivered to the card dealing shoe by an advancing member. A separation paddle acts as a barrier between the playing cards already in the shoe and the playing cards being delivered to the shoe. Upon completion of the delivery operation, the paddle is removed and placed at the end of the stack of cards. A jogging mechanism assures uniform stacking of the playing cards. The shuffling, stacking and jogging operations do not conflict with the dispensing of playing cards from the shoe.

37 Claims, 17 Drawing Sheets

LOAD IT:

PURPOSE: To allow user to load cards onto lift

I/O INTERFACE: None

STRATEGY: Open door (M7 Up)
Wait for front and back switches to acknowledge position status
Close door (M7 down)
Run lift to opto AA (M8 down)

NOTES: None

UPFEED:

PURPOSE: To feed the loaded cards to the rollers

I/O INTERFACE: IF PASS=1 then the top of the card stack is leaving from OPTO AA position
IF PASS=2 then the top of the card stack is leaving from OPTO CC position STRATEGY: Set Elevator (M8) move distance pending.pass status
Move M8 up high speed to just below rollers
Turn rollers on (M9 & M10)
Move Elevator (M8) up at low speed to Datum
Turn rollers off (M9 & M10)

NOTES: M9 or M10 are either On or Off

LDPOINT:

PURPOSE: To position Elevator (M8) at OPTO CC location

I/O INTERFACE: None

STRATEGY: Run Elevator (M8) down high speed
Wait for OPTO CC to change state
Stop Elevator (M8)

NOTES: None

SLIDE:

PURPOSE: To randomly cut the cards by bringing left and right arms (M5 or M6) in and out I/O INTERFACE: Pending system clock selects M5 or M6 to move first STRATEGY: Randomly select M5 or M6
Bring in left or right arm
Bring other arm in
Bring other arm out
Bring out the arm that moved first
Execute LDPOINT NOTES: System being used must have valid internal clock

*Fig. 7d*

LWR4:

PURPOSE: To deliver shuffled cards to shoe

I/O INTERFACE: Pending value of PASSLWR (1 OR 2) execute INSET 3

STRATEGY:
Move Elevator (M8) to bottom of chamber
If PASSLWR=1 Execute INSET 3
Move Drawbridge (M4) DOWN
Move Secondary block (M1) DOWN
Perform pressure relief move
IF PASSLWR=2 Execute INSET 3
Move Primary block (M2) UP
Move Paddle (M3) DOWN
Kill (free) M2
Return Drawbridge (M4), Then Secondary block (M1) to DATUM
Return Elevator (M8) to OPT AA location NOTES: None

INSET 3:

PURPOSE: To move Paddle (M3) UP

I/O INTERFACE: None

STRATEGY:
Move Paddle (M3) 00220,020 UP
Wait till move command is complete

NOTES: None

DITHER:

PURPOSE: To stack or adjust cards properly in shoe

I/O INTERFACE: None

STRATEGY:
Select Primary block (M2)
Energize M2
Move M2 – 00100,010 UP
Wait till move command completes
Kill (free) M2

NOTES: None

*Fig. 7e*

METHOD AND APPARATUS FOR AUTOMATICALLY SHUFFLING AND CUTTING CARDS AND CONVEYING SHUFFLED CARDS TO A CARD DISPENSING SHOE WHILE PERMITTING THE SIMULTANEOUS PERFORMANCE OF THE CARD DISPENSING OPERATION

FIELD OF THE INVENTION

The present invention relates to playing card shuffling and cutting apparatus, and more particularly, to a novel device for automatically shuffling playing cards and delivering shuffled playing cards to a card dealing shoe, which operations may be conducted automatically and simultaneously with the dispensing of playing cards and without interference with the card dispensing operation.

BACKGROUND OF THE INVENTION

A number of playing card games exist wherein the playing cards are dispensed from a playing card dispensing or dealing shoe which is capable of holding one or more playing card decks and as many as six, eight, or even ten decks. It is customary to shuffle all of the playing card decks preparatory to initiating play as well as during various stages in the play of the cards. In addition thereto, it is customary to shuffle all of the decks after all of the cards, or substantially all of the cards contained within the dispenser shoe have been dispensed. A shuffling operation requires the exercise of some degree of care and is further complicated when a large number of decks must be shuffled. The rules of the game typically provide that the cards be shuffled in clear view of all of the players. In an effort to increase playing time, it is desirable to provide automatic shuffling apparatus for reducing the time, effort and manual care required to shuffle the decks of playing cards. Typically, after cards have been in play, they are held in a dead box provided on the playing surface and are held there until the marker card reaches the exit opening of the dealing shoe. At that point, play is stopped and the cards are then shuffled and cut preparatory to beginning play again. The time consumed in the shuffling and cutting operations prevents continuation of the game and requires a significant amount of time during which play is halted to complete the shuffling operations, thus significantly reducing the interest of the players in the game and, in fact, serves to induce people to leave the game due to the lengthy delays caused by shuffling.

In addition, the ability to permit numerous shuffling and cutting operations without reducing playing time, reduces the ability of "card counters" to accurately determine the cards in the dealing shoe.

BRIEF DESCRIPTION OF THE INVENTION

The present invention is characterized by comprising a method and apparatus for automatically shuffling and cutting playing cards and delivering shuffled and cut playing cards to the dispensing shoe without any human intervention whatsoever once the playing cards are delivered to the shuffling apparatus. In addition, the shuffling operation may be performed as soon as the play of each game is completed, if desired, and simultaneously with the start of a new game, thus totally eliminating the need to shuffle all of the playing cards (which may include six or eight decks, for example) at one time. Preferably, the cards played are collected in a "dead box" and are drawn from the dead box when an adequate number of cards have been accumulated for shuffling and cutting using the method of the present invention.

The present invention comprises a computer controlled shuffling and cutting system provided with a housing having at least one transparent wall making the shuffling and card delivery mechanism easily visible to all players and floor management in casino applications. The housing is provided with a reciprocally slidable playing card pusher which, in the first position, is located outside of said housing. A motor-operated transparent door selectively seals and uncovers an opening in the transparent wall to permit the slidably mounted card pusher to be moved from its aforementioned first position to a second position inside the housing whereupon the slidably mounted card pusher is then withdrawn to the first position, whereupon the playing cards have been deposited upon a motorized platform which moves vertically and selectively in the upward and downward directions.

The motor driven transparent door is lifted to the uncovered position responsive to the proper location of the motor driven platform, detected by suitable sensor means, as well as depression of a foot or hand-operated button accessible to the dealer.

The motor driven platform (or "elevator") lifts the stack of playing cards deposited therein upwardly toward a shuffling mechanism responsive to removal of the slidably mounted card pusher and closure of the transparent door whereupon the playing cards are driven by the shuffling mechanism in opposing directions and away from the stack to first and second card holding magazines positioned on opposing sides of the elevator, said shuffling mechanism comprising motor driven rollers rotatable upon a reciprocating mounting device, the reciprocating speed and roller rotating speed being adjustable. Alternatively, however, the reciprocating and rotating speeds may be fixed; if desired, employing motors having fixed output speeds, in place of the stepper motors employed in one preferred embodiment.

Upon completion of a shuffling operation, the platform is lowered and the stacks of cards in each of the aforementioned receiving compartments are sequentially pushed back onto the moving elevator by suitable motor-driven pushing mechanisms. The order of operation of the pushing mechanisms is made random by use of a random numbers generator employed in the operating computer for controlling the system. These operations can be repeated, if desired. Typically, new cards undergo these operations from two to four times.

Guide assemblies guide the movement of cards onto the platform, prevent shuffled cards from being prematurely returned to the elevator platform and align the cards as they fall into the card receiving regions as well as when they are pushed back onto the elevator platform by the motor-driven pushing mechanism.

Upon completion of the plurality of shuffling and cutting operations, the platform is again lowered, causing the shuffled and cut cards to be moved downwardly toward a movable guide plate having an inclined guide surface.

As the motor driven elevator moves downwardly between the guide plates, the stack of cards engages the inclined guide surface of a substantially U-shaped secondary block member causing the stack to be shifted from a horizontal orientation to a diagonal orientation. Substantially simultaneously therewith, a "drawbridge-like" assembly comprised of a pair of swingable arms pivotally mounted at their lower ends, are swung downwardly about their pivot pin from a vertical orientation to a diagonal orientation and serve as a diagonally aligned guide path. The diagonally aligned stack of cards slides downwardly along the inclined guide surfaces and onto the draw bridge-like arms and are moved downwardly therealong by the U-shaped secondary block member, under control of a stepper motor, to move cards toward and ultimately into the dealing shoe.

A primary block, with a paddle, then moves between the cut-away portion of the U-shaped secondary block, thus applying forward pressure to the stack of cards. The secondary block then retracts to the home position. The paddle is substantially rectangular-shaped and is aligned in a diagonal orientation. Upon initial set-up of the system the paddle is positioned above the path of movement of cards into the dealing shoe. The secondary block moves the cut and shuffled cards into the dealing shoe and the paddle is lowered to the path of movement of cards toward the dealing shoe and is moved against the rearwardmost card in the stack of cards delivered to the dealing shoe. When shuffling and cutting operations are performed subsequent to the initial set-up, the paddle rests against the rearwardmost card previously delivered to the dealing shoe. The shuffled and cut cards sliding along the guide surfaces of the diagonally aligned arms of the draw bridge-like mechanism come to rest upon the opposite surface of the paddle which serves to isolate the playing cards previously delivered to the dispensing shoe, as well as providing a slight pushing force urging the cards toward the outlet slot of the dispensing shoe thereby enabling the shuffling and delivering operations to be performed simultaneously with the dispensing of playing cards from the dispensing shoe.

After all of the newly shuffled playing cards have been delivered to the rear end of the dispensing shoe, by means of the U-shaped secondary block the paddle which is sandwiched between two groups of playing cards, is lifted to a position above and displaced from the playing cards. A movable paddle mounting assembly is then moved rearwardly by a motor to place the paddle to the rear of the rearmost playing card just delivered to the dispensing shoe; and the paddle is lowered to its home position, whereupon the motor controlling movement of the paddle assembly is then deenergized enabling the rollingly-mounted assembly supporting the paddle to move diagonally downwardly as playing cards are dispensed from the dispensing shoe to provide a force which is sufficient to urge the playing cards forwardly toward the playing card dispensing slot of the dealing shoe. The force acting upon the paddle assembly is the combination of gravity and a force exerted upon the paddle assembly by a constant tension spring assembly. Jogging (i.e., "dither") means cause the paddle to be jogged or reciprocated in opposing forward and rearward directions at periodic intervals to assure appropriate alignment, stacking and sliding movement of the stack of playing cards toward the card dispensing slot of the dealing shoe.

Upon completion of a game, the cards used in the completed game are typically collected by the dealer and placed in a dead box on the table. The collected cards are later placed within the reciprocally movable card pusher. The dealer has the option of inserting the cards within the reciprocally slidable card pusher into the shuffling mechanism or, alternatively, and preferably, may postpone a shuffling operation until a greater number of cards have been collected upon the reciprocally slidable card pusher. The shuffling and delivery operations may be performed as often or as infrequently as the dealer or casino management may choose. The shuffling and playing card delivery operations are fully automatic and are performed without human intervention as soon as cards are inserted within the machine on the elevator platform. The cards are always within the unobstructed view of the players to enable the players, as well as the dealer, to observe and thereby be assured that the shuffling, cutting and card delivery operations are being performed properly and without jamming and that the equipment is working properly as well. The shuffling and card delivery operations do not conflict or interfere with the dispensing of cards from the dispensing shoe, thereby permitting these operations to be performed substantially simultaneously, thus significantly reducing the amount of time devoted to shuffling and thereby greatly increasing the playing time, as well as providing a highly efficient random shuffling and cutting mechanism.

The system is controlled by a microcomputer programmed to control the operations of the card shuffling and cutting system. The computer controls stepper motors through motor drive circuits, intelligent controllers and an opto-isolator linking the intelligent controllers to the computer. The computer also monitors a plurality of sensors to assure proper operation of each of the mechanisms of the system.

OBJECTS OF THE INVENTION

It is, therefore, one object of the present invention to provide a novel shuffling mechanism in which playing cards are shuffled by separation into two independent stacks and subsequent combination of said stacks, the separation and cutting of cards being performed in a random fashion.

Still another object of the present invention is to provide a novel shuffling mechanism for playing cards and the like comprising a shuffling mechanism and motor-operated housing closure means for selectively uncovering the housing opening for the insertion of playing cards only after appropriate location of a platform utilized for holding playing cards and delivering the playing cards to the shuffling mechanism.

Still another object of the present invention is to provide a novel delivery mechanism for delivering shuffling cards to a playing card dealing shoe comprising stationary and movable guide surfaces along which a shuffled stack of playing cards is moved under the combined force of gravity and a constant torque spring assembly for collection within a playing card dispensing device.

Still another object of the present invention is to provide playing card delivery means cooperating with a platform for moving shuffled playing cards to the playing card delivery means which is provided with linearly movable and swingable inclined guide surfaces for respectively moving and guiding playing cards to a playing card dispensing device, whereby the playing cards are moved along the guide surfaces by the linearly movable guide means to deliver the cards to a playing card dispensing device.

Still another object of the present invention is to provide a novel paddle assembly for selectively separating playing cards presently contained within a card dispensing device from recently shuffled and cut cards being delivered thereto and to retain appropriate force upon the playing cards previously delivered to the dispensing device until the delivery operation has been completed, at which time the paddle is lifted from the stack of playing cards and is moved to a position behind the last playing card within the dispensing device.

Still another object of the present invention is to provide a novel paddle mechanism for maintaining an appropriate force urging the playing cards within the card dispensing device toward the card dispensing outlet and further including means for periodically jogging the paddle to assure proper movement of the playing cards forwardly toward the card dispensing outlet.

Still another object of the present invention is to provide a novel playing card shuffling, cutting and delivery apparatus for automatically shuffling and cutting playing cards and delivering the shuffled and cut playing cards to a playing card holding device wherein the apparatus is designed to provide both the dealer and the players with an unobstructed view of all of the playing cards being handled in the shuffling and delivery devices.

Another object of the present invention is to provide a novel computer-based, automated system for shuffling and cutting playing cards to significantly reduce the time required for shuffling and cutting and to permit shuffling and cutting to be performed substantially simultaneously with the dealing and play of the cards.

The above, as well as other objects of the present invention, will become apparent when reading the accompanying description and drawings.

BRIEF DESCRIPTION OF THE DRAWINGS

FIGS. 6*a*, 6*b* and 7*a*–7*e* show flow diagrams and program steps utilized in the computer control system shown in FIG. 5.

DETAILED DESCRIPTION OF THE INVENTION

Figure 1A:
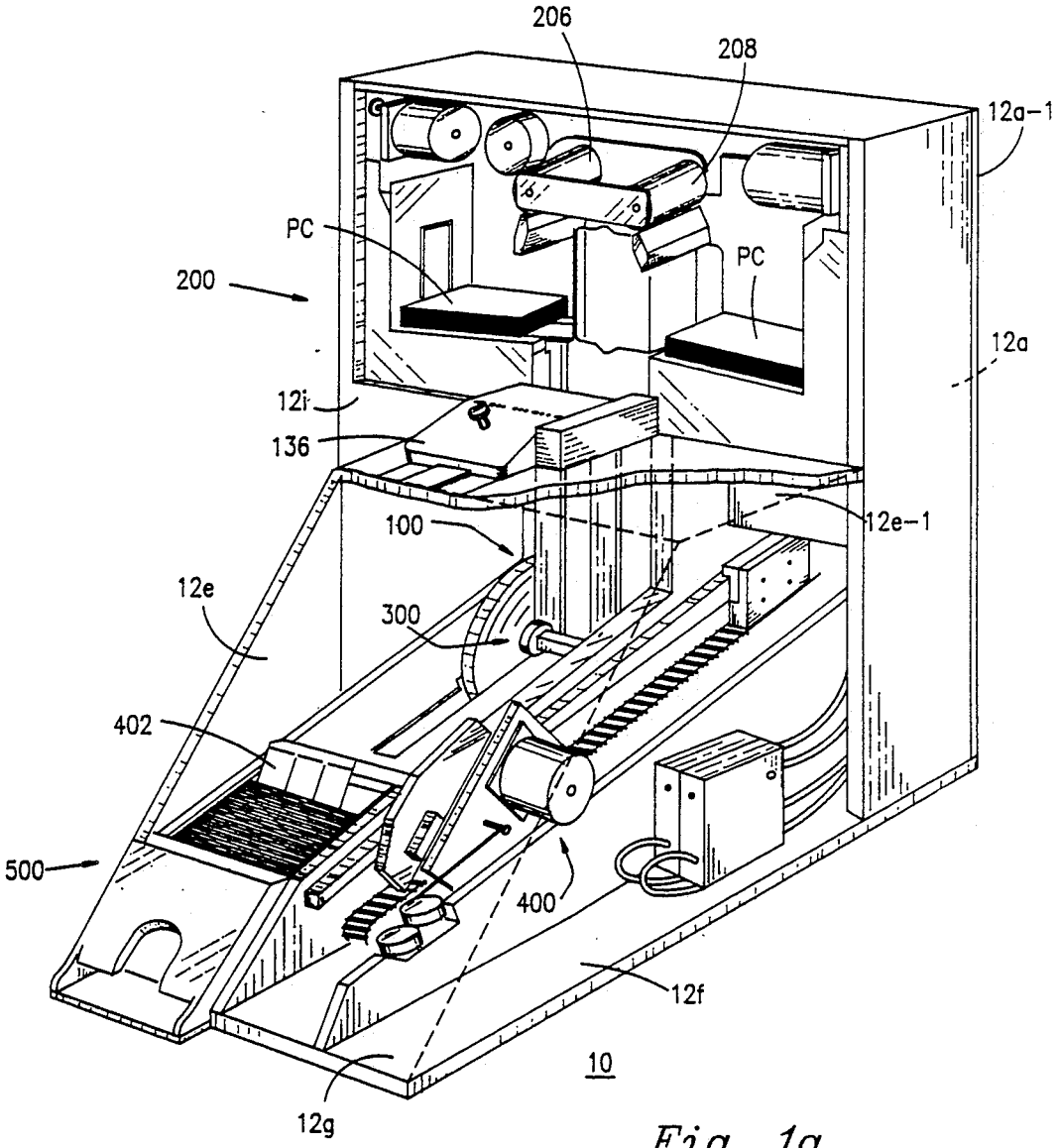
FIG. 1*a* shows a perspective view of the card shuffling and cutting system embodying the principles of the present invention.
Figure 1B:
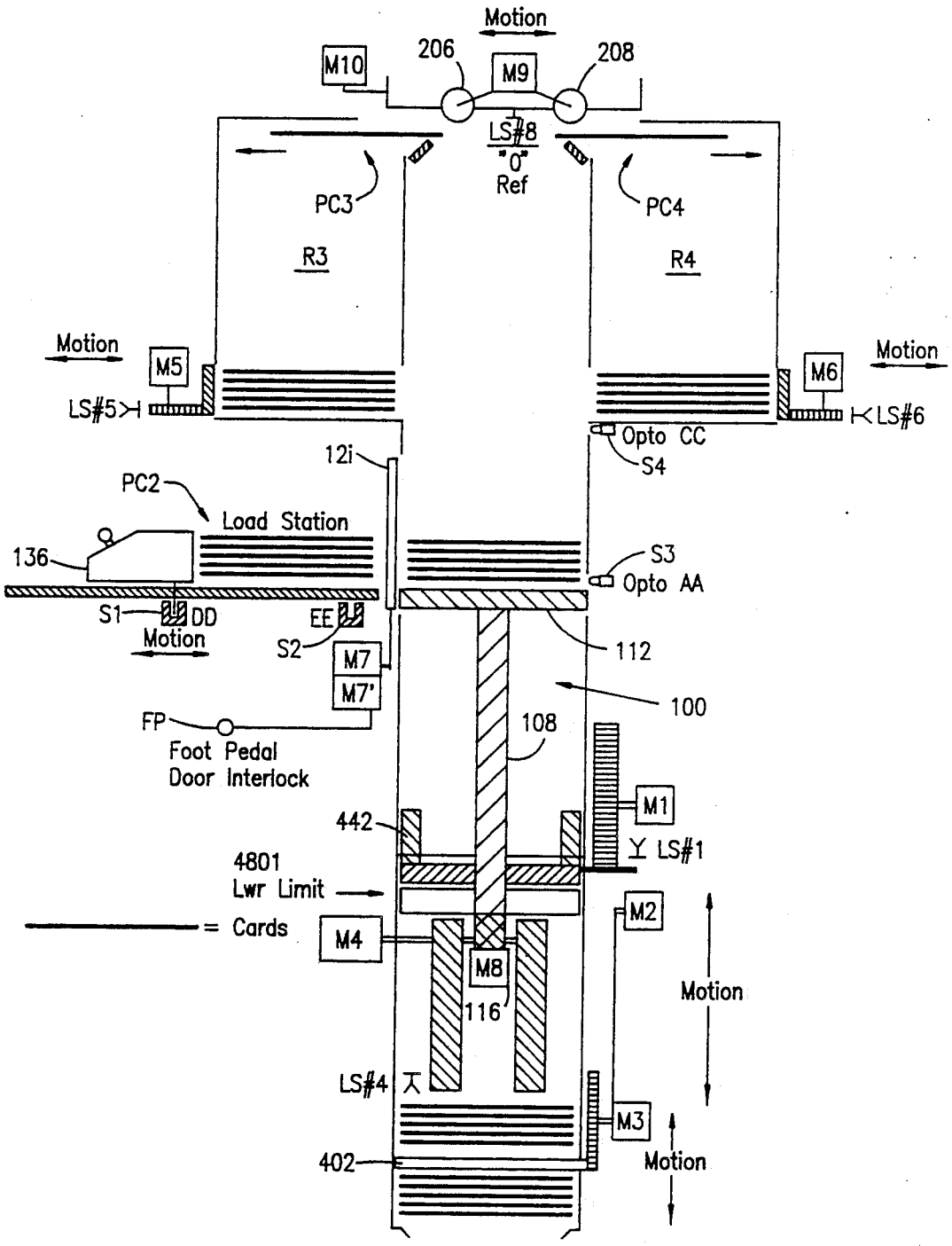
FIG. 1*b* shows a simplified schematic view of the system of FIG. 1 and showing the sensing mechanisms and motor drives utilized to control the mechanisms employed in the system of FIG. 1.
Figure 3:
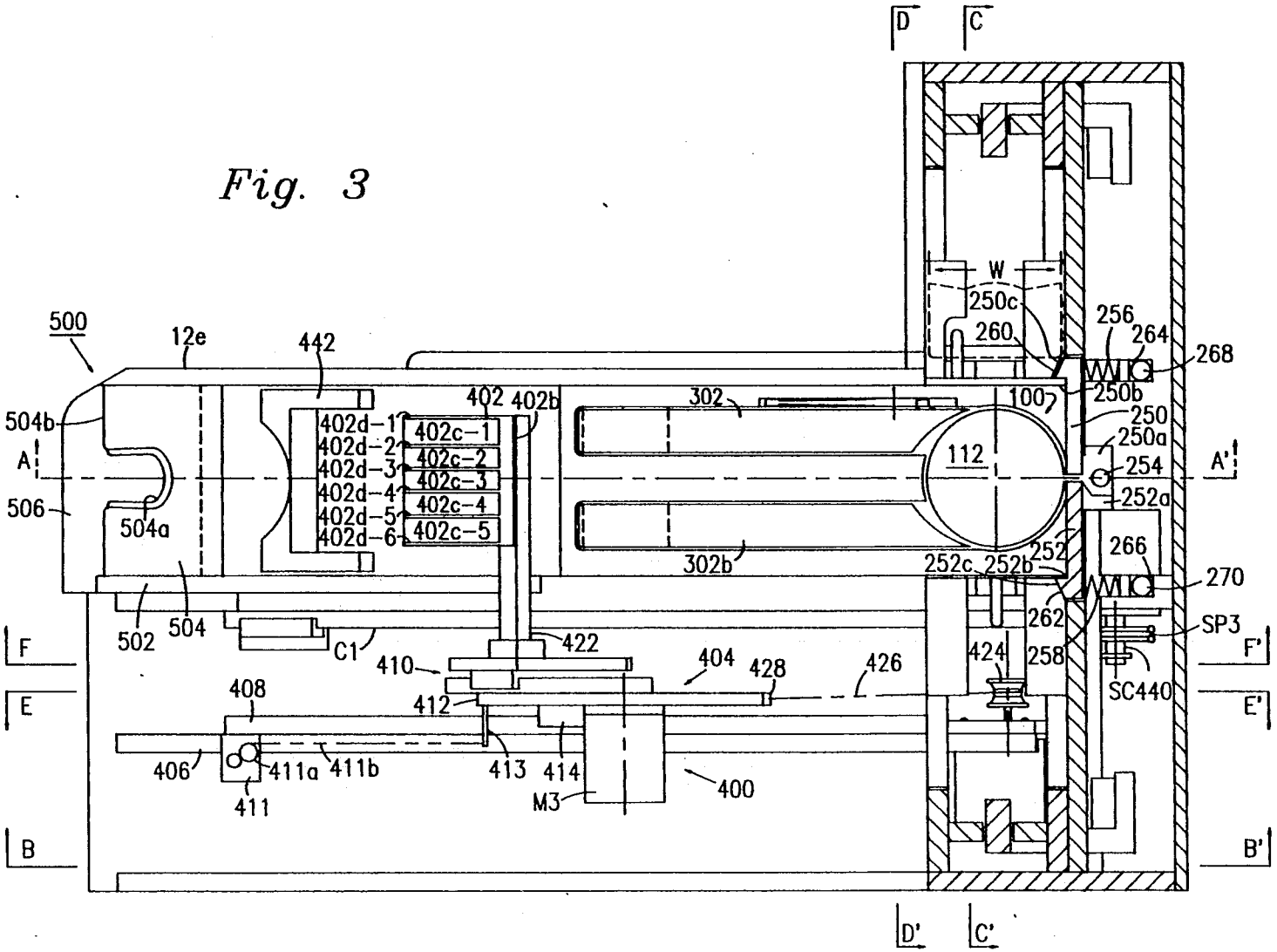
FIG. 3 shows a plan view, partially sectionalized, of the system of FIG. 1*a*.
Figure 4A:
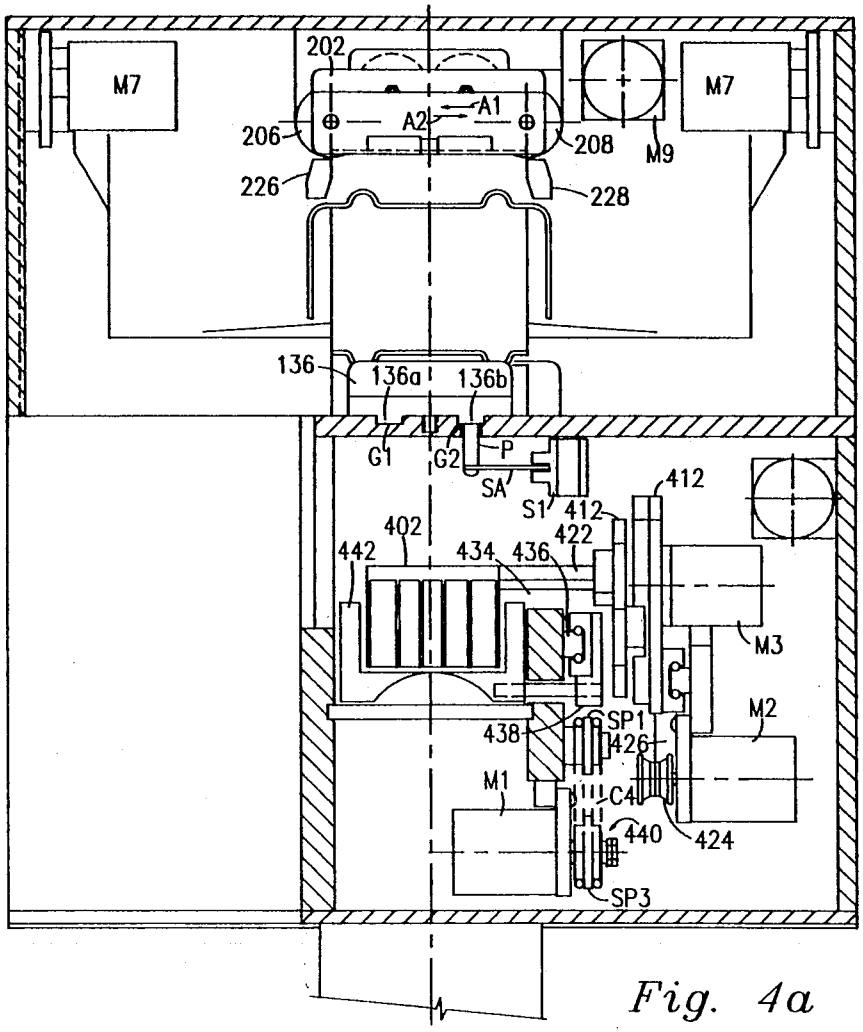
FIGS. 4*a* and 4*b* show sectional elevation views of the system of FIG. 1*a* looking in the direction of arrows C—C' and D—D', respectively of FIG. 3.

FIGS. 1*a* and 1*b* show perspective and simplified schematic views of the card shuffling and cutting system 10 of the present invention which is comprised of an elevator section 100, a card shuffling and cutting section 200, a drawbridge assembly 300 and a shoe delivery and card alignment assembly 400. Each of these assemblies or subsystems will be considered in conjunction with FIGS. 1*a* and 1*b* and with more detailed FIGS. 2*a*–4*e*. The electrical system is shown in FIG. 5 and identifies essentially all of the system electronics utilized to monitor and operate the system. The system, which is a ten axis card handling system is comprised of an aluminum frame or housing 12 principally including the rear vertical support wall 12*a* supporting the shuffling and cutting assembly, top wall 12*b*, vertical sidewalls 12*c* and 12*d*, substantially supporting and enclosing the elevator assembly 100, card shuffling and cutting assembly 200 and the drawbridge assembly 300. Vertical sidewalls 12*e*, 12*e*-1, 12*f* and front wall 12*g* enclose the card shoe assembly 500 and the shoe delivery and card aligning assembly 400. A rear closure plate 12*a*-1, parallel to wall 12*a*, covers the rear wall 12*a* and is joined to sidewalls 12*c*, 12*d*.

The front panels, such as front panels 12*e*, 12*e*-1, 12*f*, 12*g* and 12*h*, as well as a movable panel 12*i* arranged in front of the card shuffling and cutting assembly 100 (see FIGS. 2*a* and 2*b*) are preferably formed of a suitable clear plastic. These panels allow full view of the cards at all times to assure proper operation of the equipment and the card handling operations, as well as meeting the strict requirements of operating casinos and gaming commissions.

Figure 2A:
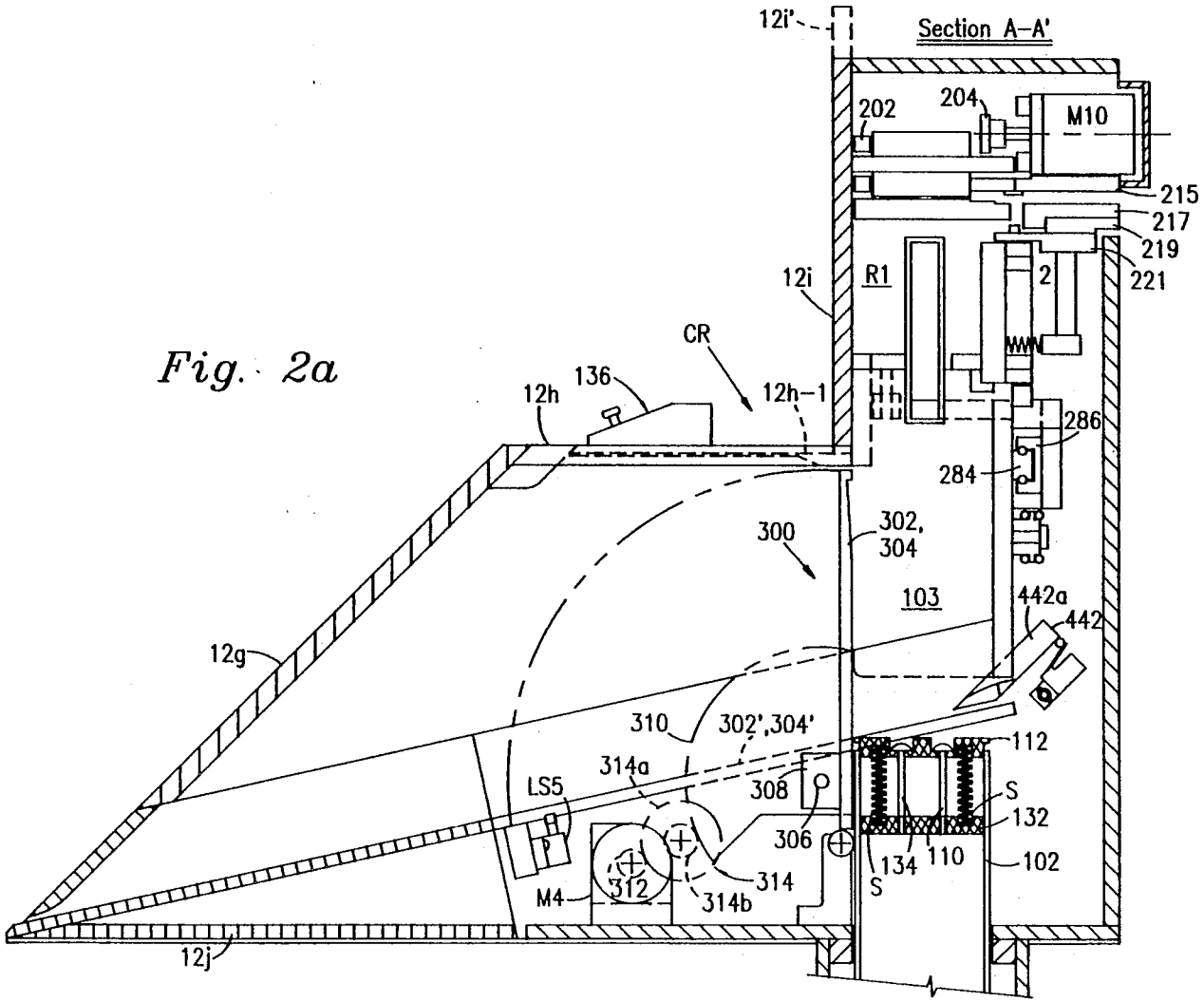
FIG. 2*a* shows an elevational view, partially sectionalized, of the system of FIG. 1 and taken along the lines A—A of FIG. 3.
Figure 3A:
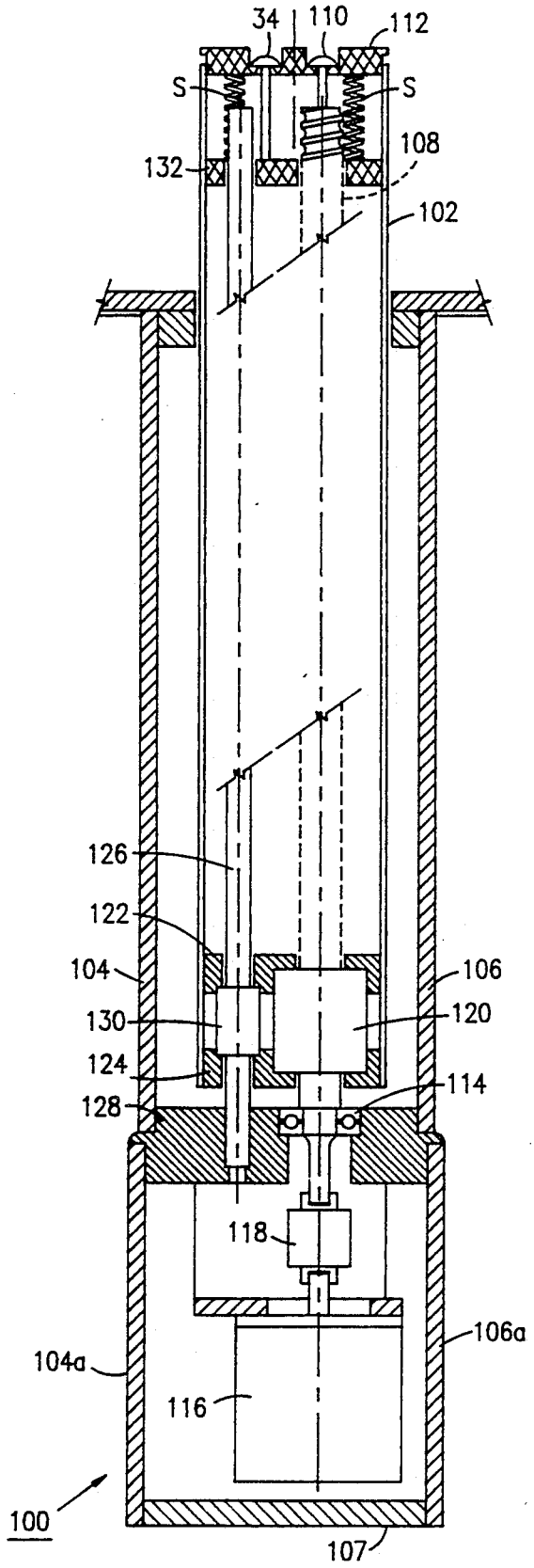
FIG. 3*a* shows a sectionalized elevational view of the elevator assembly.
Figure 4B:
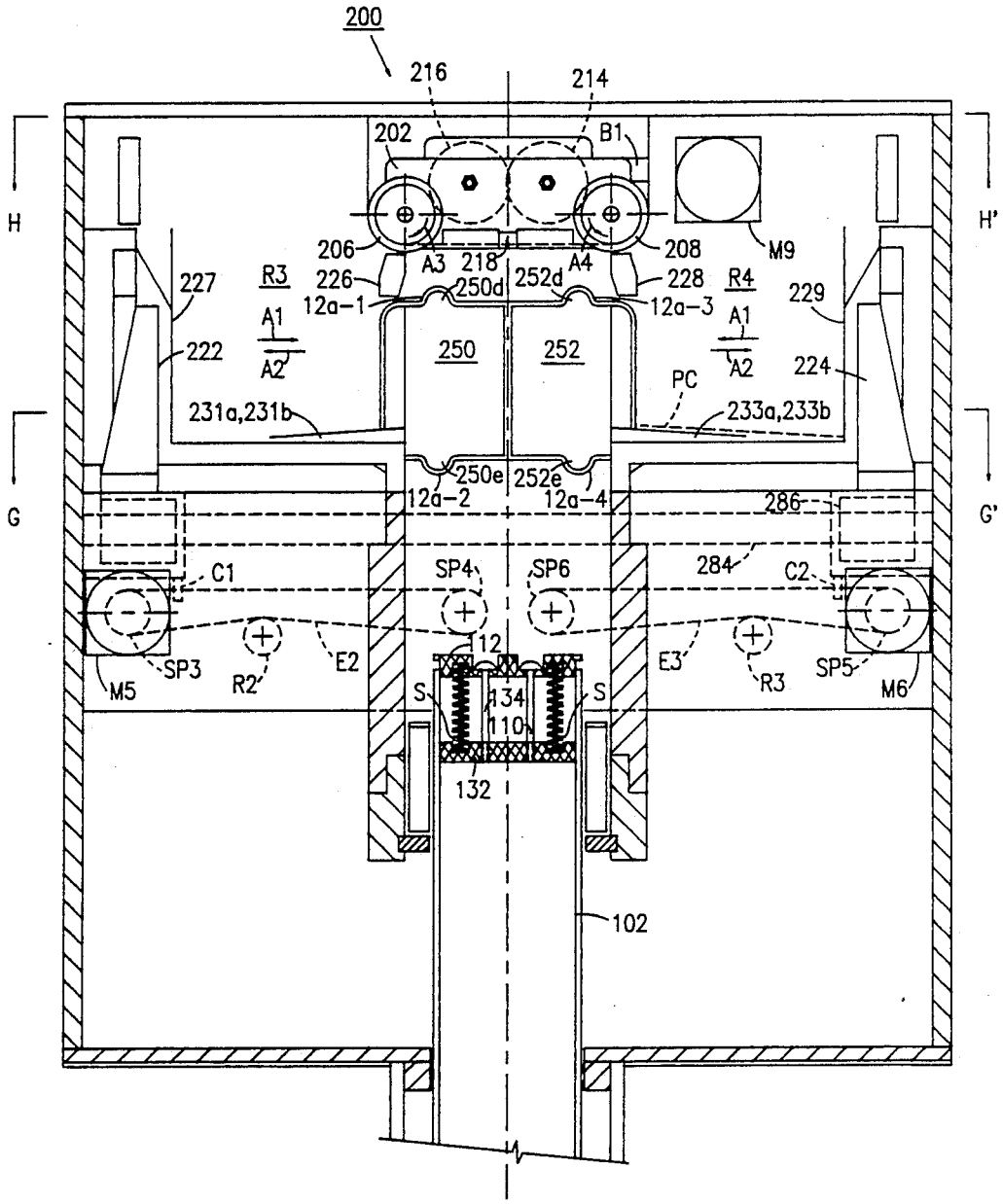
Figure 5:
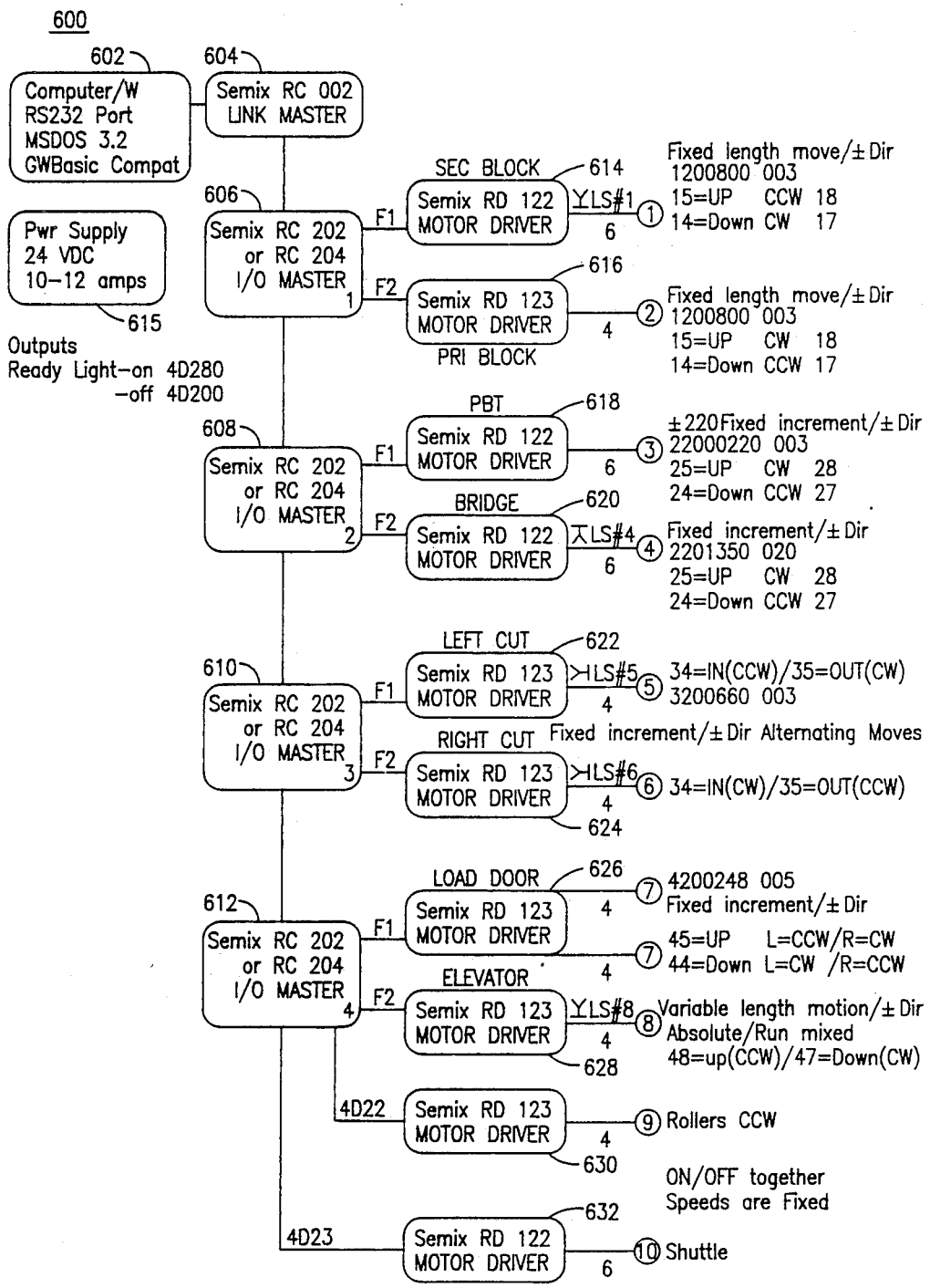
FIG. 5 shows a simplified, schematic view of the system electronics.

The elevator assembly 100, shown in FIGS. 1*a* and 1*b* and shown in greater detail in FIGS. 2*a*, 3*a* and 4*b*, is comprised of an elongated hollow cylindrical housing 102 movable within the hollow region 103 defined by parallel sidewalls 104 and 106 and driven by a lead screw 108 journaled between pin 110 extending through an opening in an upper disk 112 and journaled within a bearing 114 at its lower end. A stepping motor 116, housed within walls 104*a*, 106*a* and floor 107, is coupled to the lower end of lead screw 108 by means of coupling 118. A threaded nut 120 is fixedly secured at the lower end of cylinder 102 by disk-shaped brackets 122, 124. Rotation of lead screw 108 by stepper motor 116 causes the elevator cylinder 102 to move upwardly or downwardly, according to the direction of rotation of the lead screw. Guide shaft 126 is fixedly secured within a support disk 128 and extends substantially the entire length of cylinder 102, passing through a guide collar slide bearing 130 secured between support disks 122 and 124. The upper ends of shaft 126 and lead screw 108 extend through clearance openings in an upper disk-shaped member 132 fixedly secured to the interior of cylinder 102. Pins 110 and 134 have their lower ends respectively secured to disk 132 and lead screw 108 and have their head portions extending through openings in disk 112. Helical springs S normally urge platform 112 upwardly. Pins 110 and 134 limit the upper movement of platform 112. The elevator assembly is utilized to selectively lift and lower cards, the cards being lifted during the shuffling operation and being lowered during the cutting operation and the operation utilized to deliver cards which have been adequately shuffled and cut to the dealing shoe, as will be more fully described.

Figure 4C:
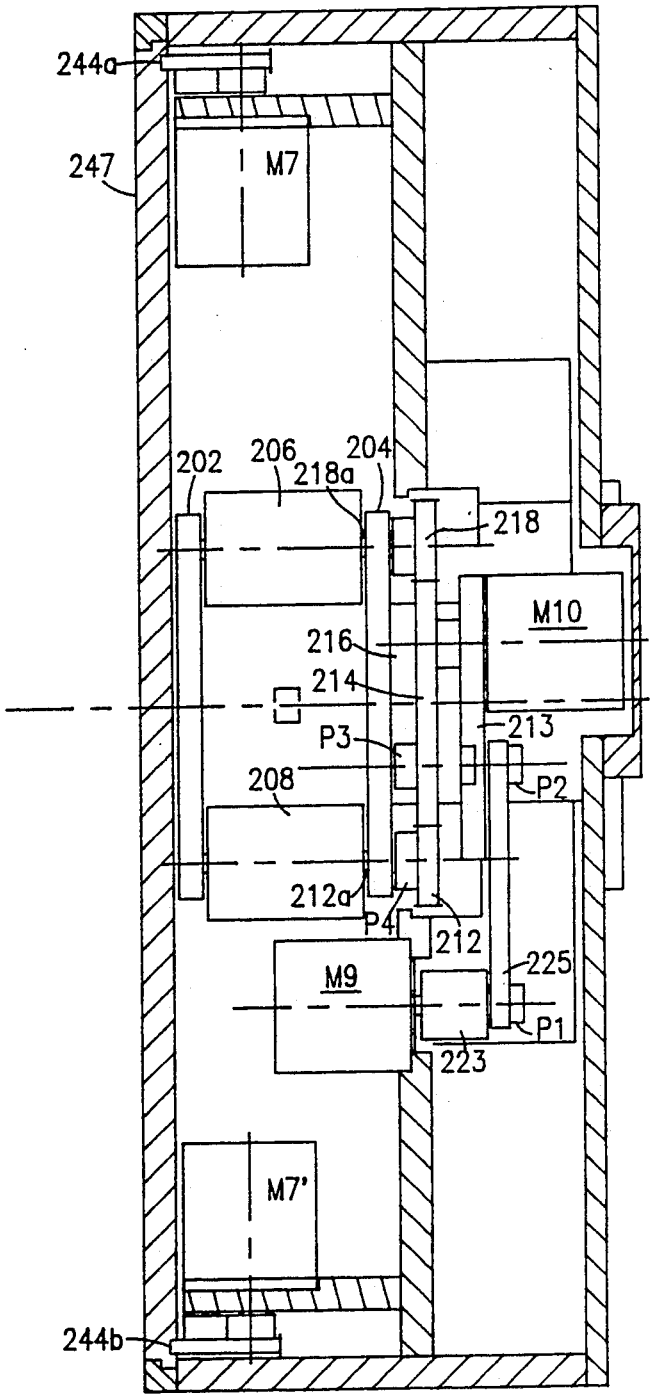
FIG. 4*c* shows a sectional view looking in the direction of arrow H—H' of FIG. 4*a*.
Figure 4D:
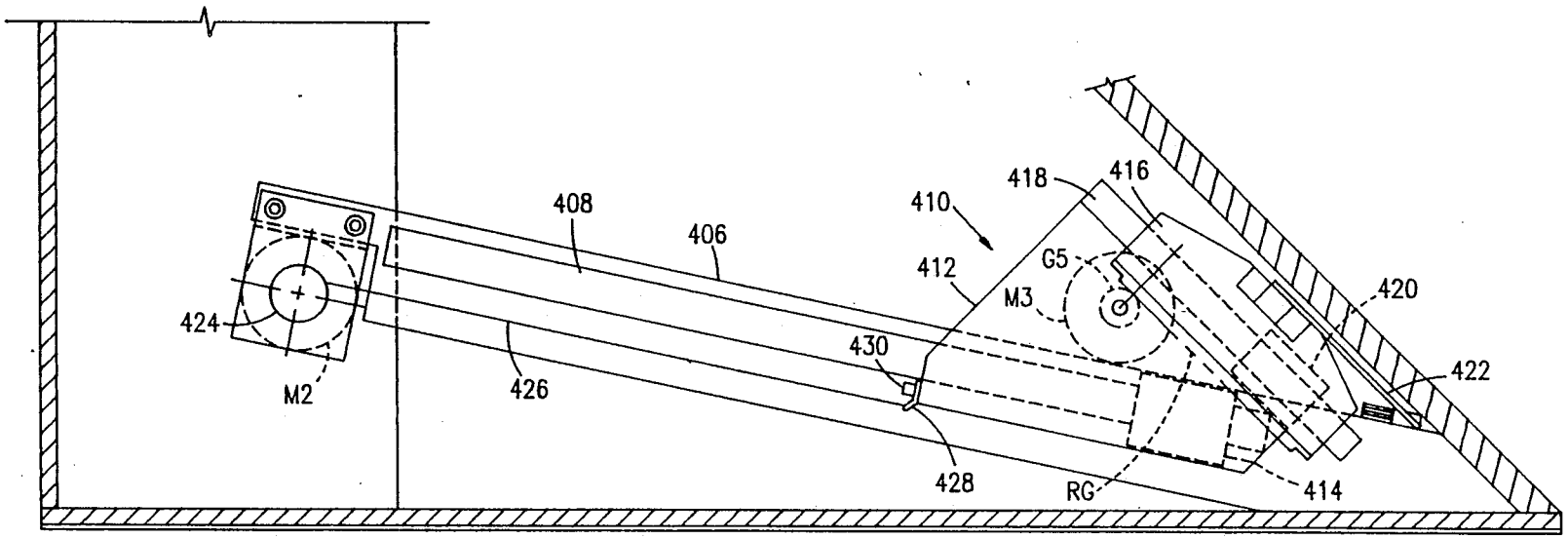
FIG. 4*d* shows a sectional view taken along the lines E—E' of FIG. 3.

The elevator housing is partially beneath the floor 12*j* of the system housing and partially above floor 12*j* and extends upwardly toward the shuffling assembly of rollers 206 and 208 (see FIGS. 4*c* and 4*d*). The lower housing portion is arranged beneath the table (not shown) upon which the system 10 is placed.

The cards to be shuffled and cut are placed upon a card receiving region CR shown in FIG. 2*a* which is located upon the surface of transparent cover 12*h*, which is provided with a recess 12*h*-1 for receiving playing cards. The playing cards are laid upon the recess 12*h*-1 so that they are horizontally aligned, each card resting upon the card below. A pusher member 136 is slidable within elongated guide grooves G1 and G2 provided in transparent member 12*h*, as shown, for example, in FIGS. 2*a* and 4*a*. Projections 136*a* and 136*b* of pusher 136 extend into the respective guide grooves G1 and G2 for slidable movement therealong and to prevent a card or cards from sliding into the region between the bottom of pusher 136 and the top of cover 12*h*. A pin P integrally joined to projection 136*b* extends downwardly and carries a thin sensor arm SA which is movable between the arms of a pair of sensors S1 and S2 for sensing the position of the pusher 136 (note also FIG. 1*b*).

FIGS. 2*a*, 3, 4*a* and 4*b* show the doors 250, 252 arranged behind the elevator assembly 100. Each of the doors is hingedly connected at their adjacent inner ends by means of a pin 254, FIG. 4*d* showing one of the brackets 250*a* for swingably mounting door 250 to pin 254. Bracket 252*a* is partially obscured by bracket 250*a* in FIG. 4*d*. The top and bottom ends of doors 250, 252 are provided with rounded projections 250*d*, 250*e*, 252*d*, 252*e* extending upwardly and downwardly into curved cut-away portions 12*a*-1, 12*a*-2, 12*a*-3 and 12*a*-4 in rear wall 12*a*. These rounded portions prevent cards moving toward wall 12*a* and doors 250, 252 from moving into the gap space between the tops and bottoms of doors 250, 252 and the surrounding cut-out portion of wall 12*a* receiving doors 250, 252.

The opposite ends of the doors 250 and 252 are spring-loaded by springs 256 and 258 which urge the outer ends of the doors against conforming surfaces 260 and 262 which serve as stops to respectively limit the counterclockwise and clockwise movement of the doors 250 and 252 about pivot pin 254. Springs 256 and 258 have their left-hand ends arranged within suitable recesses provided in the rearward surfaces of doors 260 and 262 and have their right-hand ends arranged within recesses provided in blocks 264 and 266, which blocks are each arranged at the lower end of a dowel 268, 270, dowel 268 being shown in FIG. 2*a* as having its upper end secured to stationary block 221. The doors are designed to guide a group of cards are delivered into the card receiving area by pusher 136 shown in FIG. 2*a*. The shoulders 250*b* and 252*b* provided in doors 250 and 252 serve to properly align the groups of cards pushed onto the platform. In addition thereto, the bevelled surfaces 250*c* and 252*c* of the doors are designed to align cards pushed onto the platform by pushers 222, 224 and also enable the door whose bevelled surface is engaged by the cards to move out of the way as a group of cards is pushed onto the platform. For example, assuming that a group of cards is pushed onto the elevator 100 from a position above the elevator relative to FIG. 3, the bevelled surface 250*c* aligns the cards as they start to engage the bevelled surface and thereafter enables door 250 to be pushed out of the way. The shoulder 252*b* of the other door, however, serves as a means to limit the movement of the group of cards pushed onto the elevator platform, to further aid in aligning the cards returned to the platform by the pushers 222, 224.

The cards fed to the left and right by rollers 206, 208 engage walls 227, 229 (FIG. 4*b*) which absorb some of the energy of the cards as they strike these surfaces. The bevelled surfaces 250*c*, 252*c* prevent cards rebounding from these surfaces from entering into the region occupied by the platform 112, since the space between the bevelled surfaces 250*c*, 252*c* and the interior surface of movable door 12*i* is less than the width W of a playing card PC shown in dotted fashion in FIG. 3.

When moving a group of cards from the position below the elevator 100 relative to FIG. 3, doors 250 and 252 operate in the reverse fashion, bevelled surface 252*c* aiding in the alignment of cards pushed onto the platform 112 by pusher 224 (FIG. 4*b*) causing door 252 to move out of the way while shoulder 250*b* or door 250 serves as a means to limit the movement of cards pushed onto the elevator platform.

The regions R3 and R4 (FIG. 4*b*) are provided at their lower ends with a pair of wedge-shaped members 231*a*, 231*b* and 233*a*, 233*b* which serve as ramps requiring the cards to move upwardly as they are pushed onto platform 112 by pushers 222, 224. Cards delivered to regions R3 and R4 by rollers 206, 208 ultimately fall onto ramps 231, 233. The ramps cause the cards to slide toward the associated rear walls 227, 229 aiding in the alignment of the cards preparatory to being pushed upon the platform 112 by pushers 222, 224. FIG. 4*b* shows a typical playing card PC (in dotted fashion) resting upon ramps 233*a*, 233*b*.

Figure 2B:
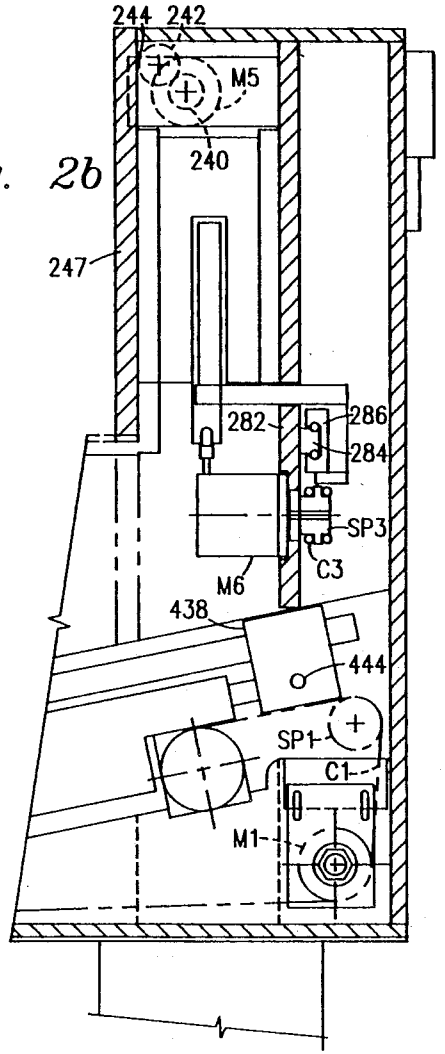
FIG. 2*b* shows a partial view of a vertical section of the system of FIG. 1*a* looking in the direction of arrows B—B of FIG. 3.

The region R1 (see FIGS. 2*a*, 4*a* and 4*c*) into which the cards are moved is typically sealed by movable transparent panel 12*i* which is selectively lifted upwardly by motors M7, M7′ to the position as shown in dotted fashion at 12*i*′ in FIG. 2*a* in order to gain access to the chamber R1 receiving the cards. Motors M7 and M7′, shown best in FIGS. 2*b* and 4*c*, are each provided with an output gear 240 and an intermediate gear 242 for engaging the rack 244*a*, 244*b* arranged along opposite vertical sides of the transparent window 247. Stepper motors M5 and M6 are driven in unison to selectively lift or lower window 247.

As will be explained in greater detail hereinbelow, a shuffling operation cannot be initiated until the panel 12*i* is moved upwardly to the open position to gain access to the card receiving region R1. As shown in FIG. 1*a*, a foot pedal P, which is manipulated by the dealer, energizes motors M7, M7′ to lift panel 12*i* upwardly when the pusher 136 is at its rearmost position, as sensed by sensor S1 (FIG. 1*b*), which operation will be described in detail hereinbelow.

In addition to the above, the platform 112 of elevator assembly 100 must be located at a position lower than the surface of the card receiving recess CR (FIG. 2*a*) before panel 12*i* may be lifted, as will be more fully described hereinbelow. The position of the platform is sensed by optical-type sensors S3 and S4 shown in FIG. 1*b*.

The card shuffling and cutting assembly 200 is shown best in FIGS. 2*a*, 4*a*, 4*b* and 4*c* and is comprised of a pair of movably mounted plates 202, 204 which rotatably support friction rollers 206, 208 on shafts represented by phantom lines as shown. The rollers may be formed of rubber or a rubber-like material or a rigid material coated or covered with suitable friction material for driving cards left and right, as will be more fully described.

Motor M10 has its output shaft coupled to a gear 216. Gear 216 meshes with gear 218 for driving roller 206 through shaft 218*a*. Gear 216 meshes with gear 212 through idler gear 214 for rotating roller 208 through shaft 212*a*. The motor M10, gears 212–218 and rollers 206 and 208 are all mounted upon a slidable mounting member 215 the lower end of which is provided with a slide bearing 217 for slidably moving the mounting assembly upon a rail 219 arranged upon a horizontally aligned stationary member 221 as shown best in FIG. 2*a*. If desired, the gears may be replaced by timing belts or other suitable drive means.

Motor M9 has an eccentric 223 mounted upon its output shaft. An elongated rod 225, pivotally coupled to eccentric 223, imparts this rotating motion, which is converted to a reciprocating motion, to mounting member 213 secured to the upper end of rod 225 (relative to FIG. 4*c*) by pin P2.

The speeds of stepper motors M9 and M10 are adjustable to change the shuffling sequence which is totally random. Motors M5 and M6 shown in FIGS. 2*b*, 4*a* and 4*b*, respectively drive ladder-like cables B2 and B3, entrained about sprockets SP3, SP4 and SP5, SP6 respectively for operating pushers 222, 224. Rollers R2 and R3 maintain the appropriate tension for cables B2 and B3. Coupling members C1, C2 respectively couple the slidable pusher assemblies 222, 224 to cables B1, B2 for movement of the pushers respectively toward and away from one another, as shown by the arrows A1, A2 for pushing (i.e., "cutting") shuffled cards back into the center compartment, as will be more fully described. The order of movement of pushers 222, 224 is made randomly by means of a random number generator provided in the operating computer, to be more fully described.

The card shuffling and cutting assembly 200 receives the cards to be shuffled and cut from the elevator which initially moves at high speed toward rollers 206, 208 and when reaching the rollers then delivers the cards upwardly against rollers 206, 208 at a slow rate of speed by means of the elevator assembly 100. The cards are guided toward rollers 206, 208 by stationary guide members 226, 228 which serve to align the pack of cards as it is delivered upwardly and further serve to limit the number of cards which may move through the gap formed by the upper surface of each guide member 226, 228 and its associated friction roller 206, 208. Preferably, no more than one (1) card can pass through the gap defined by a friction roller and its associated guide. The roller assembly reciprocates back-and-forth as shown by arrows A1 and A2 and the rollers rotate clockwise and counterclockwise as shown by arrows A3 and A4 (see FIGS. 4*a* and 4*b*) causing the cards engaged by the rollers to be fed into either a left-hand or right-hand collection region R3 or R4, respectively. When all of the cards have been shuffled, as sensed by the elevator reaching "0" datum, the elevator is lowered at high speed to a position just below the bottom of the collecting regions R3 and R4, motors M5 and M6 are energized and the pushers 222 and 224 alternately push one or the other group of shuffled cards back into the center region above the collection platform 112 of the elevator assembly whereupon the pushers 222 and 224 return to their original positions shown in FIG. 4*b*, in readiness for subsequent card shuffling and cutting operations. The sequence of operation of the pushers 222 and 224 occurs in a random fashion under control of a random generator provided in computer 602 (FIG. 5).

The drawbridge assembly 300 is comprised of a pair of swingable drawbridge arms 302, 304 (see FIGS. 2*a* and 3) which are swingably mounted upon a common pin 306 passing through brackets 308 integral with the drawbridge arms 302 and 304 and extending downwardly from the bottom surfaces thereof.

The drawbridge arms 302, 304 include an integral gear sector 310. Stepper motor M4 drives a gear 312 which in turn drives an outer gear member 314*a* of an intermediate gear 314, having an integral inner gear portion 314*b* which meshes with sector gear 310 for the purpose of lifting and lowering the drawbridge arms. The drawbridge arms, when upright, provide adequate clearance for the elevator assembly 102 to move upwardly and downwardly, with or without a group of cards deposited on platform 112.

The card shoe assembly 500 comprises an enclosure defined by sidewalls 12*e* and 502 and a diagonally aligned forward wall 504 having a substantially U-shaped opening 504*a* for receiving the thumb of the dealer to dispense cards stored within the card shoe, the cards being dispensed between the lower edge 504*b* of member 504 and the bottom surface 506 of the card shoe.

Figure 4E:
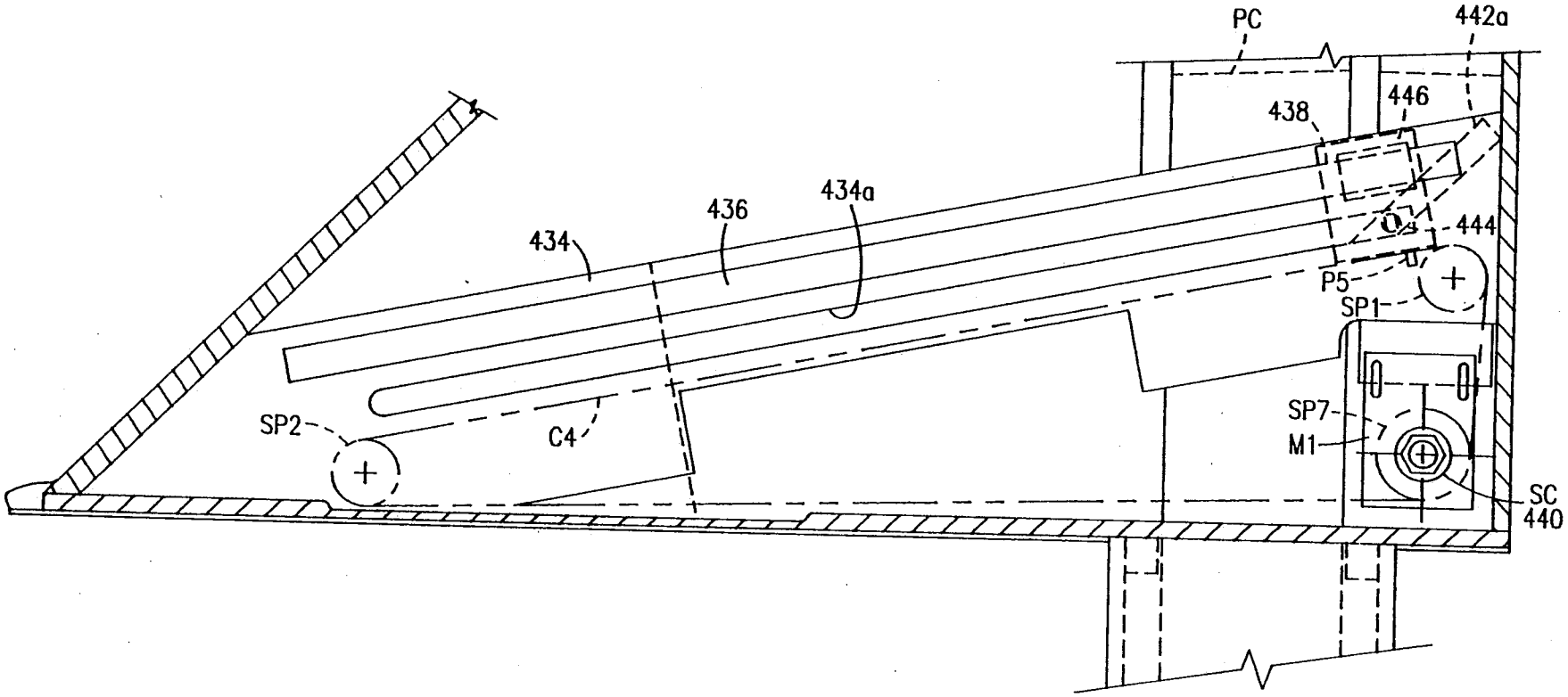
FIG. 4*e* shows a sectional view looking in the direction of arrows F—F' of FIG. 3.

The card delivery and card alignment assembly 400 comprises an elongated plate 406 (shown in FIGS. 3 and 4*d*). Plate 406 is provided with an elongated rail 408 for slidably supporting a paddle mounting assembly 410 comprised of a mounting plate 412. A slide bearing 414, shown in dotted fashion in FIG. 4*d* and shown in solid-line fashion in FIG. 3, enables slidable movement of the paddle mounting assembly 410 along rail 408. Motor M3 shown in FIGS. 3, 4*a* and 4*d* has a gear G5 mounted upon its output shaft, which gear meshes with a rack gear RG arranged along the underside of a paddle supporting block 416. A rail 418 is arranged along the upper right-hand side of plate 412. A slide bearing 420 shown in dotted fashion in FIG. 4*e* is secured to mounting block 416 and slidably engages rail 418 to move block 416 therealong under control of stepper motor M3. A paddle arm 422 is secured to mounting block 412 (see FIGS. 4*a* and 4*d*) and extends to the left thereof and is integrally joined to paddle 402. Paddle 402 is tapered and is of reduced thickness at its lower end 402*a* and is greater in thickness at its upper end 402*b*. The forward surface 402*c* has a plurality of recessed areas 402*c*-1, 402*c*-2, 402*c*-3, 402*c*-4 and 402*c*-5, to reduce the surface area of engagement of the paddle 402 with playing cards to the thin finger-like portions 402*d*-1, 402*d*-2, 402*d*-3, 402*d*-4, 402*d*-5 and 402*d*-6 thus significantly reducing the sliding frictional forces between paddle 402 and an engaging playing card. The rear surface of paddle 402 may be provided with a similar arrangement of fingers.

Returning to FIG. 4*d*, motor M2 has a take-up spool 424 mounted to its output shaft. A cord 426 is wound about spool 424 and has its free end secured to an eyelet 428 which in turn is secured to the left-hand end of plate 412 by a fastener 430 (see also FIG. 3). A constant tension spring 432 is joined to slide bearing 414 for urging slide bearing 414 and plate 412 downwardly and to the right relative to FIG. 4*d*.

The secondary block assembly shown in FIG. 4*e* is comprised of an elongated plate 434 having an elongated rail 436 for guiding secondary block 438 backward and forward along rail 436 and an elongated slot 434*a*. Slide block 438, shown in FIGS. 2*b*, 3 and 4*a*, is secured to a ladder chain C4 (see FIG. 4*e*) by pin P5. The ladder cable C4 is entrained about sprockets SP1 and SP2 and a sprocket SP7 mounted upon the output shaft of motor M1 and driven by motor M1 through a slip clutch assembly 440 shown in FIGS. 3, 4*a* and 4*c*.

Substantially U-shaped secondary block 442, shown in solid-line fashion in FIGS. 3 and 4*a* and in dotted-line fashion in FIG. 4*e*, is secured to block 438 by a dowel 444 which extends through elongated slot 434*a* provided in elongated plate 434, slot 434*a* being arranged below and parallel to rail 436.

A slide bearing 446 is integrally mounted to the left-hand side of block 438 as shown in FIG. 4*a* and slidably moves the block 438 and hence the secondary block 442 backward and forward along the rail 436 under control of stepper motor M1.

The card delivery system operates, briefly, in the following manner:

The secondary block 442 initially occupies the dotted line position shown in FIG. 4*e*. When a pack of playing cards PC1 which have been shuffled and cut and delivered to the platform 112 of elevator 100 (see FIGS. 1*b* and 3*a*) is lowered and the drawbridge arms have been lowered, the cards engage the diagonally aligned upper surface 442*a* of secondary block 442 (FIG. 4*e*) and move from a horizontal orientation (see playing-card PC shown in dotted fashion in FIG. 4*e*) to a diagonal orientation, controlled by the diagonally aligned upper left-hand surface 442*a* of the secondary block.

The paddle 422 is moved generally upwardly and to the left relative to FIG. 4*d* (i.e. upward and to the right relative to FIG. 4*e*) to be removed from the pack of cards just outside of the enclosure of the card dealing shoe assembly 500, under control of motor M3. The paddle 422 is then positioned above the cards.

The paddle mounting assembly 410 is then moved rearwardly or in the direction from right to left under control of motor M3 as shown in FIG. 4*d*.

Motor M1 then drives the secondary block 442 downwardly and to the left relative to FIG. 4*f* to push the cards on the drawbridge members 302, 304 (FIG. 3) received from the descending elevator, toward the card shoe. The motor M1 is driven through a predetermined number of stepping pulses (preferably 800) to urge the cards into the dealing shoe 500. Since the number of step pulses applied to motor M1 is far greater than the amount needed to push the cards into the dealing shoe 500, the slip clutch 440 permits the cable to slip relative to the drive motor to allow any unknown number of cards to be pushed to the front of the shoe assembly or to push cards hard against the back of the paddle 402. The computer then applies a predetermined number of stepping pulses (preferably approximately 50) to motor M1 to reverse the motor and thereby move the block 442 rearwardly and away from the rear end of the cards in the dealing shoe.

When the cards being delivered by the secondary block 442 reach the cards remaining in the card shoe assembly, the paddle is moved downwardly under control of motor M3.

Motor M2 is deenergized, allowing the paddle mounting assembly 410 to move downwardly and to the right relative to FIG. 4*d* under control of gravity and under control of the constant tension spring assembly 411 which includes a string 411*b* wound about spool 411*a* 413. The spool 411*a* is under constant torque by means of a spring (not shown) causing string 411*b* to exert a constant tension upon paddle assembly 412.

FIG. 5 shows a simplified schematic drawing for the system electronics for operating the card shuffling and cutting system of FIGS. 1*a* and 1*b*. The system electronics 600 is comprised of a central computer which may be of the lap-top type located remote from the system 10, one suitable computer being the Toshiba T1100-P. However, any computer utilizing the MOS-DOS 3.2 operating system or higher is satisfactory for use in the electronic system of the present application. The computer 602 may be arranged beneath the dealing table. The computer 602 is provided with an RS 232 port and is electrically connected to four microprocessor-based intelligent controllers 606, 608, 610 and 612 which are linked with the computer 602 by an opto-isolating circuit 604. The microprocessor-based intelligent controllers 606–612 may, for example, be Semix RC 202 or RC 204 models and the link master circuit may be a Semix RC 002. However, any other suitable intelligent controllers and coupling means may be utilized. 24 volt power supplies 615 supplying 24 volts at 10–12 amps., power the system electronics.

In a system of the present invention built for production, the electrical control system may preferably be converted to surface mount device technology for reducing the power handling section and the computer handling section to a fraction of its present size. The supervisory control computer 602 may also be integrated into the system so that it operates totally self-contained and without remote computer equipment and the complete control section may be located within the card handling section itself or the support stand which carries the equipment.

Figure 6A:
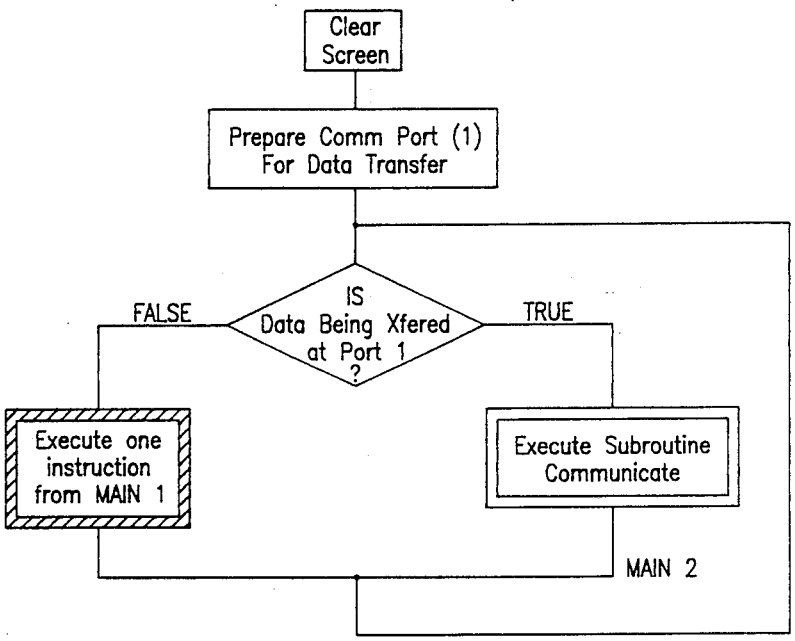
Figure 6B:
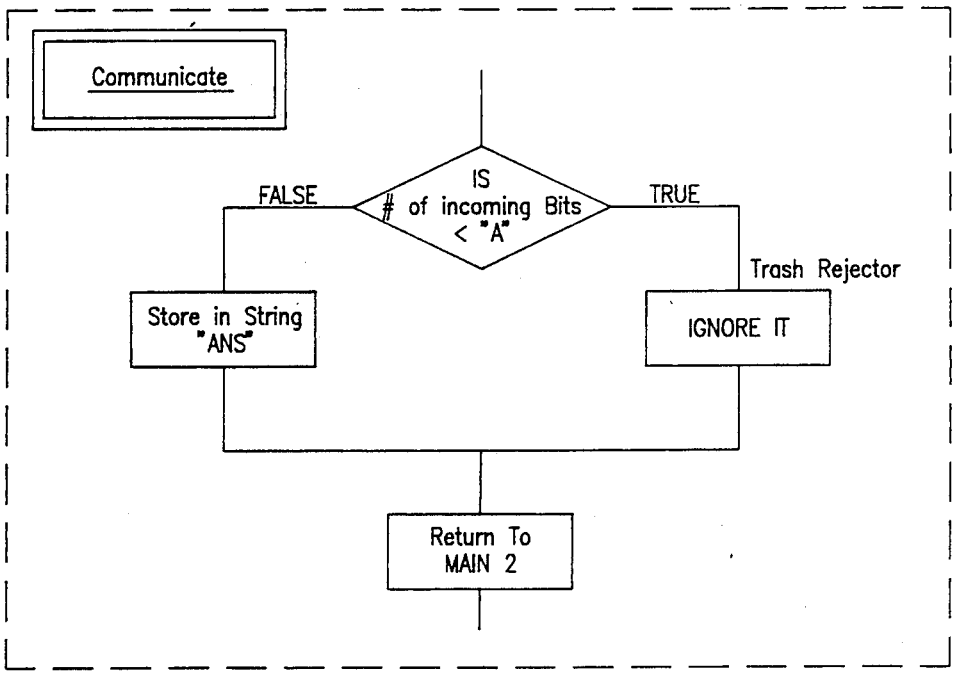

The electronic system 600 further comprises ten motor drivers 614–632. Motor drivers 614 and 616 are coupled to the intelligent controller 606. Motor drivers 618 and 620 are coupled to intelligent controller 608; motor drivers 622 and 624 are coupled to intelligent controller 610; and motor drivers 626, 628, 630 and 632 are coupled to intelligent controller 612. The motor drivers may be any suitable electronic device capable of providing the necessary power for operating the stepper motors M1 through M10, respectively. In the preferred embodiment, motor drivers 614, 618, 620 and 630 are preferably of the Semix RD 122 type while the remaining motor drivers 616, 622, 624, 626, 628 an 632 are of the Semix RD 123 type. However, any other suitable motor drivers may be utilized FIG. 6 shows the capability and operating parameters of each motor driver for operating their associated stepper motors Stepper motors M1 through M7, M9 and M10 are all approximately one inch diameter, two amp. six lead motors. However, these motors may be substituted by motors with different winding characteristics, if desired. The stepper motor M8 driving the elevator is preferably a 2.2 inch diameter single stack, eight lead stepper motor. Motors M8 through M10 may be substituted by constant speed motors, if desired. The motors described are available from a variety of suppliers. Suitable stepper motors for use in the present invention include: standard 1.8°, 200 step per revolution hybrid permanent magnet stepping motors available from Clifton Precision Company or Oriental Motors, for example.

The operation of the system, under control of the electronics, will now be considered in conjunction with all of the aforementioned FIGS. 1*a* through 5 together with the flow diagrams shown in FIGS. 6 and *7a–7d*. Initially, the computer checks to see that all critical axes are at their proper home set point (see FIG. *7a* - "Intialize all I/O Masters"). Any axis not found at the correct position is ordered there by the computer and normal play is prohibited until all such conditions are satisfied. This is undertaken at the first step shown in FIG. *7a*.

Limit switch LS1 (see FIG. *1b*) is examined first and if not closed, all other motion by any axis is inhibited until this axis is at the home position Motor M1 is energized to drive the secondary block 442 (see FIG. 3) to the solid line position shown in FIG. *2a*.

The elevator then finds the load level point established by optical sensor OPTO AA (FIG. *1b*) and positions itself at the datum point at the top of the elevator shaft. The drawbridge system is then commanded down to a home position on the shoe bottom which is identified by a limit switch LS5 shown in FIG. *2a*. Finally, the left/right card cutting (i.e., "pusher") arms 222, 224 (see FIG. *4b*) are also sent to the home position as shown in solid line fashion in this Figure. Once these steps are accomplished during initialization, the system is ready to begin play.

The card handling system of the present invention has the capacity to handle six decks of cards in normal operation. It is anticipated that typically four decks of cards will be in the machine at any given time. However, it is possible for the user to dictate the use of eight, ten or twelve decks of cards in the play of the game employing the machine of the present invention.

The following example sets forth the play with eight decks of cards.

The operator cuts and washes four decks of cards prior to starting the system. These cards are then loaded into a secondary dead box (not shown for purposes of simplicity) located on the playing table preferably to the right of the dealer, the system of the present invention being positioned to the left of the dealer. A second group of four decks is shuffled, cut and washed. Once this is completed, the second group of cards are offered to a player at the table to insert a cut card. Cutting is performed in the normal fashion wherein the cut card, typically a card of a solid color and contrasting with the playing cards, is placed within the last group of four decks which have been shuffled, cut and washed. Thereafter, another cut card is inserted somewhere in the group of four decks by the operator and a portion of that group of cards is placed in a primary dead box likewise located to the right of the dealer. The remaining cards (PC2 - FIG. *1b*) are inserted into the load station, i.e. the card receiving region CR (see FIG. *2a*) in a sequence of three or four loads, the system of the present invention having a capacity of receiving about one and one-half (1-½) decks in the card receiving region CR.

A red light L1 (see FIG. *4a*) preferably located to the left of the elevator column indicates to the dealer that the system is ready to accept a foot pedal (FP - FIG. *1b*) input in order to open the loading door 12*i*. The loading door will open on command (by operating motors M7, M7') by depressing the foot pedal switch FP shown in FIG. *1b*, only when the red light L1 is off. L1 is off when the pusher 136 is in the back position and when the transparent panel 12*i* is open. Three to four load cycles are required to load the initial group of cards into the machine. After the final load, the door 12*i* closes under control of motors M7 and M7' and the elevator 100 lowers to find the top of the card stack (using sensor AA - FIG. *1b*). Since the number of cards may vary, computer 602 determines the stack height of the cards presently on top of the elevator platform 112 and adds this value to "the top of elevator" current position to define the new motion distance to bring the "top of the elevator" back to "zero". More specifically, computer 602 determines the number of steps required to move elevator assembly 100 downwardly to move the top of the stack just below sensor S3 (FIG. *1b*). This is done by moving the elevator down to detect the top of the stack each time a stack is delivered into the system, counting the number of step pulses the motor is driven downwardly, and summing these values. The elevator now rises at high speed a predetermined distance determined by a count in a high speed register provided in computer 602 (as will be more fully described) to a point just below the roller assembly according to the calculated sum. The elevator system 100 will then automatically shift to slow speed according to the count accumulated in a low speed register (to be more fully described) and begin to feed cards to the rollers. Motor M10 imparts a reciprocating motion to the roller assemblies while motor M9 rotates rollers 206 and 208 respectively in the clockwise and counterclockwise directions (see cards PC3, PC4 - FIG. *1b*). The cards are peeled off the top of the elevator section randomly moving either to the left or to the right depending upon the numerous electromechanical variables in the mechanism. It is not possible to determine in advance the exact number of cards which will be distributed to the left and right stack since this changes in every shuffle. It should be understood that this feature is a desirable one in order to provide a random shuffling operation.

The cards are delivered in the leftward direction by roller 206 and in the rightward direction by roller 208, the cards falling downwardly into regions R3 and R4 respectively, as shown in FIGS. *1b* and *4b*. Guides 227 and 229 respectively limit the movement of the cards in the left and right-hand directions and absorb some of the energy of the cards as they strike these guides. Ramps 231, 233 aid in aligning the cards in regions R3 and R4 preparatory to being pushed onto the elevator platform 112. When the shuffling is completed, approximately half of the shuffled cards will be piled in each of the regions R3 and R4, although the exact number in each region is uncertain and cannot be programmed, thus assuring a random shuffle.

After the last card has been removed from the top of the elevator section, at "0" datum the elevator section reverses direction and lowers down to the position of the OPTO CC position represented by sensor S4 in FIG. *1b*. In the event that a jam has occurred the pressure sensor 218 will be engaged either by a card or by platform 112 causing the system to stop.

Describing the above operation in greater detail, in the home hunt routine, the computer initially looks at sensors AA and CC; if both are blocked (from receiving light due to the elevator), the elevator is above sensor CC; if both are unblocked, the elevator is below AA; if CC is unblocked and AA is blocked, the elevator is between AA and CC. Having evaluated this data, the elevator then moves to the AA location to establish the location for the top of the elevator. The elevator is then moved upward a fixed number of counts from the AA position to establish a zero datum at the level of the rollers. The fixed pulse count is determined by the fixed geometry of the system. A register storing this count is then zeroed. The elevator is then lowered, storing the count of pulses required to move to alignment with the sensor AA and stores this count in a high speed register for use in the shuffling and cutting operations.

When cards are delivered to the system 10 after initialization, the elevator is lowered each time a group of cards (PC1 - FIG. 1*b*) is loaded on the platform to align the top of the card stack with sensor AA. The number of pulses required to lower the elevator are accumulated in a low speed register and the final sum, after all (2, 3 or 4) of the stacks of cards are loaded onto the platform, is used to drive the elevator at low speed to the DATUM position.

In operation, when all of the stacks of cards have been delivered to the platform (see PC1 - FIG. 1*b*), the elevator is driven at high speed according to the number of counts in the high speed register, thus placing the top of the stack of cards just beneath the rollers 206, 208. The elevator is then driven at low speed a distance determined by the count stored in the low speed register. In the event that the platform pushes sensor 218 upwardly, the computer senses this condition as a possible jam and stops the shuffling operation and may sound an audio and/or visual alarm, if desired.

A random number generator in computer 602 sets a random number which defines which of the arms 222, 224 (FIG. 4*b*), left to right, is activated to push the pack of shuffled cards collected in its region onto the elevator platform. The random number generator repetitively generates fractional numbers 0.1 to 0.9. When required, a fractional number is randomly selected. If it is greater than 0.5 (>0.5), one of the pushers 222, 224 is selected to move first. If it is less than 0.5 (>0.5), the other pusher is selected.

The arm first moved inwardly is maintained in its position and the elevator is lowered so that the top of the cards on the elevator platform are now just below sensor S4 (FIG. 1*b*). The remaining one of the cutting arms or pushers is then operated to move its pack of cards onto the elevator platform and the pusher is then reversed in direction to return it to the home position shown in solid line fashion in FIG. 4*b*. The cutting arm first moved inwardly is then also returned back to its home position. The elevator then proceeds downward to find the top of the card stack. The computer again calculates "the top of elevator" position from datum in order to establish the new slow speed shift point. Once accomplished, the elevator comes up again at high speed, hits the speed shift point and begins a second shuffle and cut routine which is performed in the same manner as the first shuffle and cut routine set forth hereinabove. The number of shuffles and cuts is totally programmable at the request of the operator. However, once fixed into the executable program, it is no longer editable. Typically, two (2) to four (4) cycles are provided.

At the end of the second (or nth) shuffle/cut routine, the elevator lowers the card stack to the bottom of the elevator shaft. In the initial load sequence motor M3, which is employed to control the paddle 402 to move it into or out of the cards arranged in the card shoe, it is operated to lift the paddle up and out of the shoe area. The drawbridge is lowered to allow the cards to be lowered from the elevator position to the plane of the shoe assembly. The cards are shifted from a horizontal orientation to a diagonal orientation by the secondary block 442 (see FIGS. 3 and 4*f*) whereupon the cards cascade to the card dealing section of the shoe assembly 500, being pushed along the drawbridge arms by secondary block 442 under the control of stepper motor M1.

Stepper motor M2 retracts the paddle mechanism rearwardly to a position behind the cards that have just been delivered to the shoe assembly 500 by the secondary block 442. Motor M3 is now operated to lower the paddle to the height of the cards within the shoe section. Motor M2 is released by the computer to allow a free fall of the paddle assembly in behind the cards under control of gravity as well as the constant spring mechanism to provide constant pressure on the cards in the shoe. Motor M1 is operated to return the secondary block 442 to its home position shown in dotted line fashion in FIG. 4*f*, for example. The drawbridge section controlled by motor M4 is returned to its vertical position, at which time play may now begin. The dealing of cards by the operator is substantially identical to that presently employed in conventional card shoes, it being understood that the forward end of the card shoe assembly 500 of the present invention is substantially identical to card shoe assemblies presently employed in gaming casinos.

While dealing is underway, computer 602 operates stepper motor M2 in a "dither" mode which causes the motor to rotate spool 424 (FIG. 4*e*) through an angle sufficient to draw paddle assembly 410 to the left relative to FIG. 4*e* through a distance of the order of one-eighth ($\frac{1}{8}$) inch whereupon the motor is then released enabling the paddle assembly to be moved toward the right under the influence of gravity and the constant tension spring to push the cards toward the outfeed end of the shoe to maintain card alignment and adjustment as the playing cards are removed from the dealing shoe assembly 500. The dither mode is repeated at predetermined intervals as long as the equipment is in operation.

After a hand has been played, the cards are removed from the table of play and are placed in the primary dead box. Once the dealer sees approximately two decks remaining in the shoe assembly, he takes the second group of four decks from the secondary box and presents them to a player at the table for insertion of a cut card. The cards are cut and the dealer inserts a cut card into the stack and removes approximately one deck of cards from the stack. This group of cards is placed in the primary dead box and the remainder of the cards are now loaded into the card handling system where they are shuffled and cut twice (or whatever number of times is selected) by the system 10 of the present invention and are then delivered to the shoe behind the cards already located in the shoe. This technique allows uninterrupted feed of cards to the dealer, which cards are totally randomly shuffled and cut. Essentially, the pattern is repeated over and over again throughout the play of the game as long as the system is in continuous operation. The only time washing of cards is required is when a brand new group of decks is introduced into the system.

The flow diagrams will now be considered. The clear screen and communicate routines (FIGS. 6*a* and 6*b*) are utilized at all of those stages in the main routine which require the transfer of data (either to or from computer 602) and has been shown only once for purposes of simplicity. The clear screen step is used to initiate the computer. The computer employed to operate the system 10 of the present invention need not employ a display screen. It was utilized in the embodiment described herein because it was available and in such case it was used to communicate to the operator that the home hunt routine is complete and the system awaits card loading.

The communications port is then prepared for data transfer. When data is being transferred, the program jumps to the communicate routine. When the number of bits is less than a value A, they are stored and the program returns to "MAIN 2". If the number of incoming bits is greater than A, these bits are ignored and the program returns to "MAIN 2" Port 1 of computer 602 is examined again. If no data is being transferred, the instruction following the transferred data is executed. This routine serves to eliminate reaction to "noise" transferred as data or interfering with transferred data.

Considering the diagrams of FIGS. *7a–7e* in greater detail, after initialization as described hereinabove wherein all axes within the system are moved to their home positions, and the red light is off, motor M8 is activated to move the elevator down to the sensor S3. The sensor is examined and upon detection of the movement of the elevator to the solid line position shown in FIG. 1*b*, for example, motor M8 is stopped and motor M4 is operated to move the drawbridge into the up position. A predetermined number of stepping pulses are introduced to stepper motor M4. When stepper motor M4 stops, a PASS flag and a DO IT flag are set to a count of one. Thereafter, a LOAD register is set to a count of four. The back sensor DD, sensor S1, shown in FIG. 1*b* is examined to determine whether pusher 136 is in position to receive cards. As soon as the pusher is in the proper position, the foot pedal switch is examined. When the pusher 136 is in the solid line position shown in FIG. 1*b* and the foot pedal FP is depressed, the system executes the LOADIT subprogram which is set forth in FIG. *7d* which sub-routine opens door 12*i*, examines the front switch EE, sensor S2 in FIG. 1*b*, to assure that the pusher has been pushed sufficiently forward, and thereafter examines switch DD, sensor S1, to be assured that the pusher has returned to the solid-line position shown in FIG. 1*b* in readiness for receipt of a subsequent stack of cards. Thereafter, motors M7 and M7' are operated to close door 12*i* and the elevator is lowered to move the top of the stack just delivered thereto to the OPTO AA position shown by sensor S3 in FIG. 1*b*.

Upon completion of the LOAD subprogram, the LOAD count is reduced by one. In the event that the LOAD count is not zero, the above-mentioned routine is repeated until the LOAD count steps to zero.

When the LOAD count steps to zero, the program jumps to the program step in which the PASS DITH count is set to one, a PASS count is set to one, and a SHUFFLE count is set to zero, whereupon the program executes the UPFEED routine, which as shown in FIG. *7d*, sets a predetermined count for moving the elevator a predetermined distance pending the PAST status. Motor M8 is then moved up at high speed to a predetermined distance to a position just below rollers 206 and 208 (see FIG. 4*a*). Motors M9 and M10 are then turned on and the elevator is then moved at low speed under the control of stepper motor M8 until the elevator reaches "0" datum and all cards have been shuffled. In the event of a mechanism jam limit switch 218 disables all of the motors M1–M10 at which time the system must be reset.

The program then returns from the UPFEED subroutine to examine the PASS DITH count. In the event that the count is not equal to two, the program jumps to the LOAD POINT subroutine. In the event that the PASS DITH count is equal to two, the DITHER routine is executed.

Assuming that the PASS DITH count is not two, the LOAD POINT subroutine is executed which, as shown in FIG. *7d*, causes operation of motor M8 to move the elevator platform 112 to the OPTO CC, sensor S4 position, shown in FIG. 1*b*, in order to receive the cards shuffled by rollers 206 and 208. Thus, the motor M8 is operated to move the elevator platform down at high speed until the OPTO CC sensor S4 changes state, at which time the motor M8 is halted to stop the elevator, thus placing the elevator in position to receive stacks of cards from the regions R3 and R4 receiving shuffled cards from rollers 206 and 208, respectively (see FIG. 4*b*). The program then advances to the SLIDE routine which, as shown in FIG. *7d* energizes motors M5 and M6 in a predetermined sequence according to a random number generator provided in computer 602, in which case either the left or right-hand arm is moved inwardly toward the elevator, the other arm is then moved inwardly and then outwardly and the arm that moved first is then moved outwardly. Thereafter, the PASS count is set to two. The PASS DITH count is then examined and if equal to two (2) the DITHER routine is executed. If not equal to two, the SHUFFLE count is increased by one. The SHUFFLE count is examined and if less than two, the program returns to the UPFEED subroutine performing all of the subroutines mentioned above again, after which time the SHUFFLE count is then increased by a count of one and, if it is two or greater, the program jumps to the LWR 4 subroutine, which, as shown in FIG. *7d*, is utilized to deliver the shuffled cards to the card shoe by operating motor M8 to move the elevator to the bottom of the chamber. If the PASS LWR count is equal to one, the subroutine INSET 3 is performed which, as shown in FIG. *7d* operates motor M3 a predetermined number of steps thereafter returning to the LWR 4 sub-routine whereupon motor M4 is operated to move the drawbridge down, motor M1 is operated to move the secondary block 442 downwardly to drive the cards resting against the secondary block 442 (see FIG. 4*f*) downwardly toward the card chute whereupon a pressure relief step is performed which consists of moving the secondary block rearwardly a small distance to relieve some of the force exerted upon the cards by block 442.

If the PASS LWR count is equal to two, the INSET 3 subroutine is performed which has been described hereinabove. Thereafter, the primary block, i.e. paddle assembly 410, is moved rearwardly by operation of motor M2 (see FIG. 4*e*). The paddle is then moved down by operation of motor M3 and power is released from motor M2 allowing the paddle assembly 410 to drift downwardly. Thereafter, the drawbridge is returned to the upward position by operation of motor M4 and the secondary block 442 is returned to its home or DATUM position, as shown in dotted fashion in FIG. 4*f*, whereupon motor M8 is operated to return the elevator to the OPTO AA position, sensor S3. Thereafter, the program jumps to the step where the PASS LWR count is made equal to two.

The DOIT count is then examined and if not equal to one is increased by a count of one and the program returns to the step where the LOAD count is set to four. In the event that the DOIT count is equal to one, the PASS DITHER count is set to two and the load count is set to zero, whereupon the DITHER subroutine is executed.

Figure 7A:
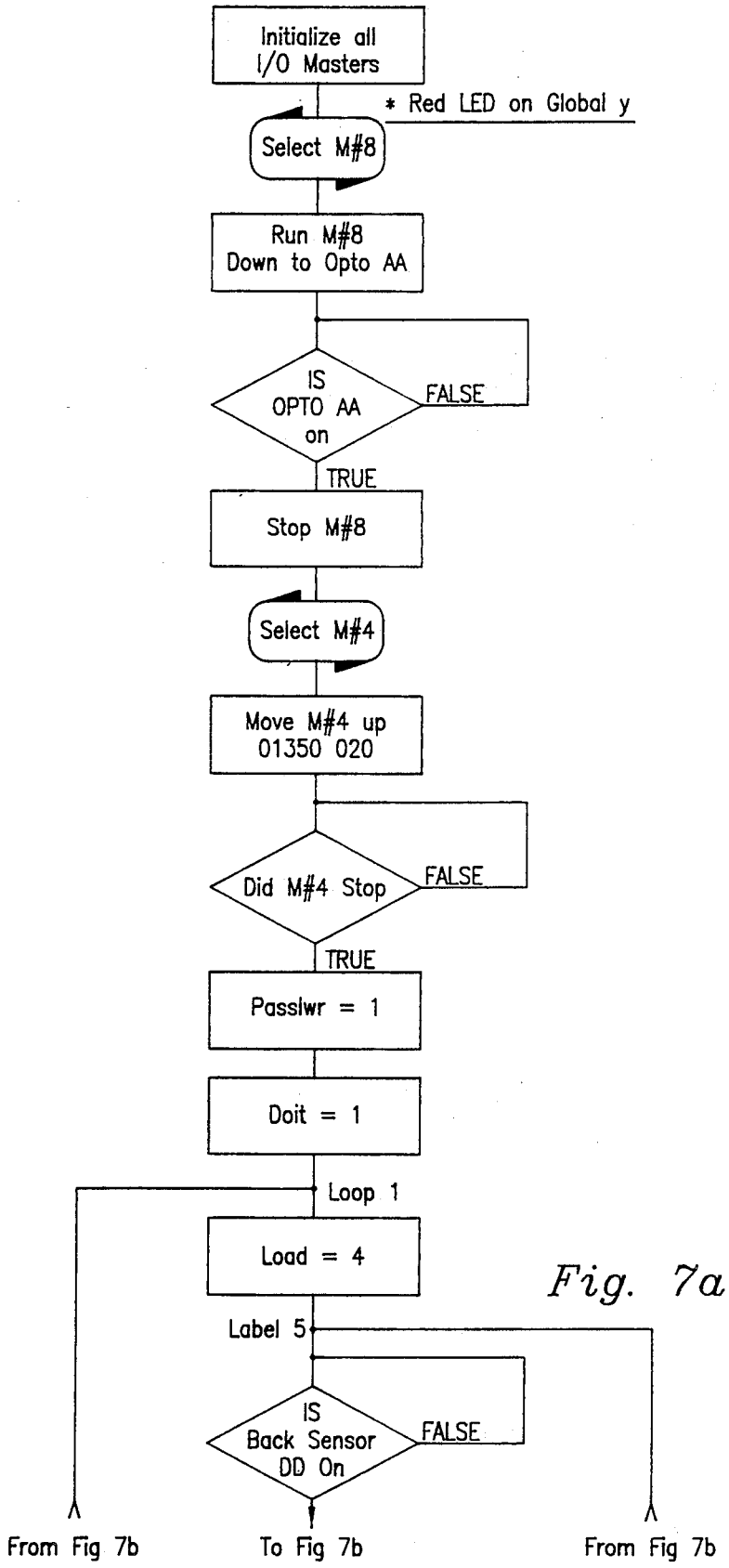
Figure 7B:
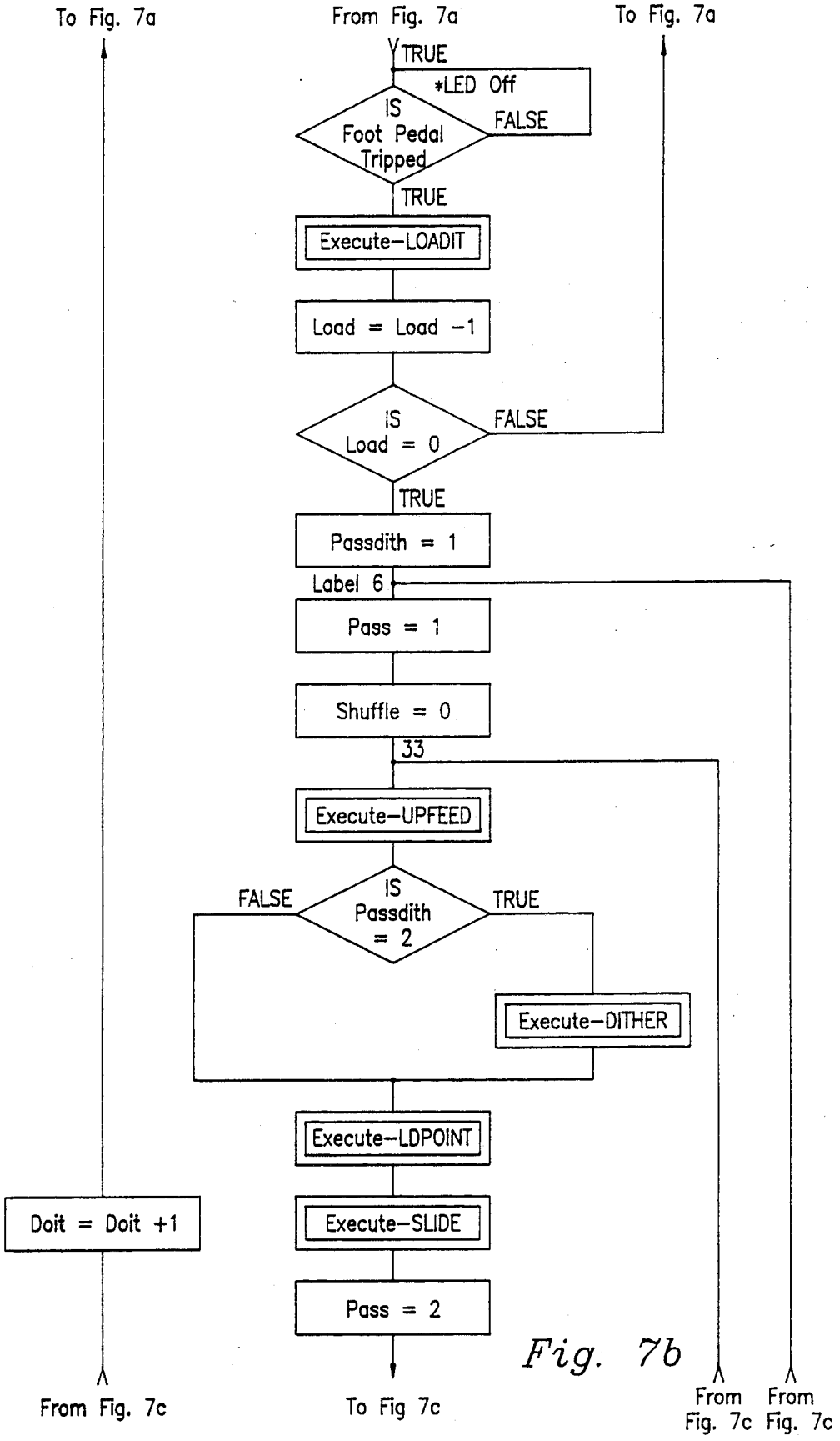
Figure 7C:
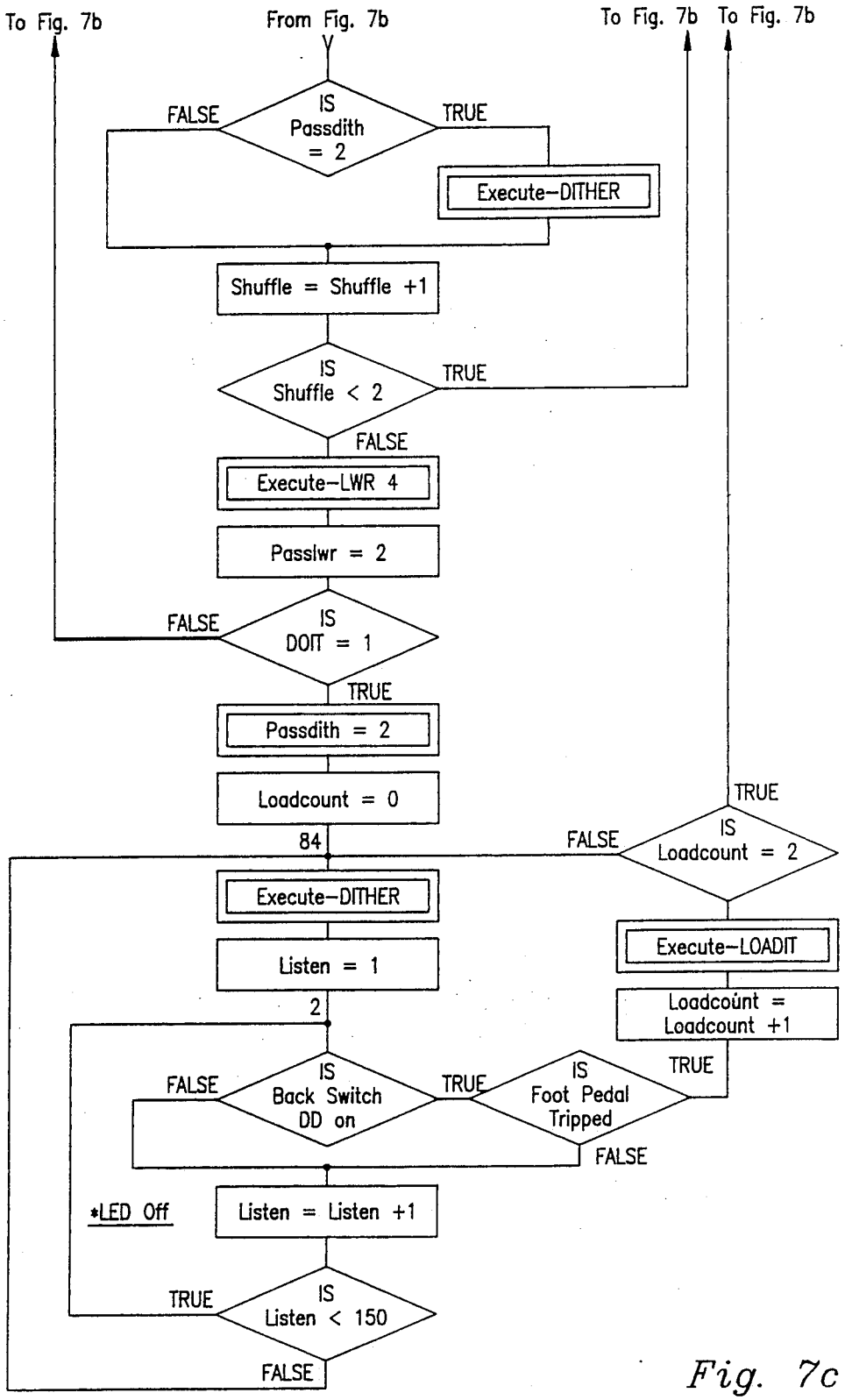

The DITHER subroutine shown in FIG. 7*d* is utilized to stack or adjust the cards properly within the dealer shoe assembly 500 and comprises selection of the motor M2 and moving the motor a predetermined number of steps sufficient to move the paddle assembly 412 rearwardly (FIG. 4*e*) a distance of the order of one-eighth inch (⅛"). Thereafter, the power to motor M2 is removed and the paddle assembly 412 is then free to drift downwardly under the control of gravity and the constant tension spring.

Thereafter, the LISTEN count is set to one, and the backswitch DD, sensor S1 (FIG. 1*b*) is examined. If the backswitch DD is not on, operation of the foot pedal FD will not be recognized and the loading door 12*i* will be inhibited from opening, thereby protecting the interior of the system within the enclosure from the intrusion of foreign objects. The LISTEN count is increased by one. The LISTEN count is then examined and if greater than 150, the program loops back to the DITHER subroutine. The dither technique is continued until either the LISTEN count reaches 150 or the backswitch DD is on in which case, if the foot pedal is tripped, the LOAD count is increased by one and the LOAD subroutine is performed. When the LOAD count is two, the program returns to the LABEL 6 position. If the LOAD count is not two, the program returns to the DITHER subroutine.

It can be seen from the foregoing description that the present invention provides a novel, substantially fully automatic card shuffling and cutting system in which the shuffling of cards which have already been used in play is not only done automatically but is performed at the same time that previously shuffled cards are available for dealing within the dealing shoe thus substantially eliminating the need for the dealer to stop card play in order to shuffle and wash a deck or decks of cards, the only exception being the initial washing of new cards introduced into the game.

The system of the present invention provides the following unique features:

1. The system of the present invention does not change the conventional play of the cards.

2. All card handling is done in full view of the dealer and the players.

3. The system employs standard casino grade playing cards.

4. No marking of the cards or cards having special characteristics are required for effective operation of the system.

5. Once the system is loaded, there is no interruption of play to shuffle and cut the cards.

6. The card delivery system feels substantially identical to the current method of card delivery to the dealer and thus does not require any "break-in" period during which a dealer must become accustomed to the use of the system and specifically the card dealing operations from the dealer shoe.

7. Card shuffling is totally random, being controlled by elevator elevation speed, reciprocating speed of the rotating rollers, rotating speed of the rotating rollers, and roller contact to the card and card separator bars. Since the shuffling is totally electromechanical in nature, it is not possible to program a known sequence or preset sequence of the cards, which is a desired objective in order to assure random shuffling of the cards.

8. Cutting of the cards is also totally random by utilization of a random number generator in the computer for selection of the left/right cutting mechanism and it is thus not known which cutting arm will be initially actuated.

9. The desired number of shuffles and cuts can be preprogrammed according to the needs and/or applications of the user.

10. The system eliminates the card counter advantage in the card game of blackjack.

11. The system of the present invention allows the operator to devote substantially all of his (or her) efforts to the dealing and delivery of the cards to the players.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein described.

What is claimed is:

1. Shuffling apparatus for mixing a plurality of playing cards comprising:

elevator means for receiving a stack of playing cards;

a shuffling station positioned above said elevator means;

first and second card receiving means positioned on opposite sides of said shuffling station;

means for moving said elevator means toward said shuffling station;

shuffling means arranged at said shuffling location for randomly feeding cards delivered to said shuffling means by said elevator means to said first and second card receiving means.

2. The apparatus of claim 1 further comprising means for moving said shuffling means in a reciprocating fashion in a direction transverse to the direction of movement of said elevator means.

3. The shuffling apparatus of claim 1 wherein said shuffling means is provided with first and second card drive means for respectively driving cards from said stack toward said first and second card receiving means in a non-uniform, random fashion.

4. The shuffling apparatus of claim 3 wherein said first and second driving means are each comprised of rotatable roller means for driving a playing card engaging the roller means in a predetermined direction.

5. The shuffling apparatus of claim 4 wherein each roller means is provided with a peripheral drive surface of a material for driving a playing card through frictional engagement between the roller means surface and the surface of a playing card.

6. The shuffling apparatus of claim 5 wherein the roller means has a rubber or rubber-like surface.

7. The shuffling apparatus of claim 6 wherein said lowering means is further comprised of sensing means for sensing when said elevator means reaches a predetermined position to generate an initiate lowering signal.

8. The shuffling apparatus of claim 1 further comprising:

lowering means responsive to removal of the playing cards on said elevator means for lowering said elevator means;

first pusher means responsive to lowering of said elevator means to a first predetermined position for pushing the cards collected in said first card receiving means onto said elevator means;

second pusher means responsive to said elevator means being lowered to a second predetermined location for pushing playing cards in said second card receiving means onto said elevator means.

9. The shuffling apparatus of claim 8 further comprising means for controlling the operating sequence of said first and second pusher means in a random fashion.

10. The apparatus of claim 9 further comprising guide means for aligning cards as they are pushed onto the elevator means in a direction transverse to the direction of movement of said pusher means, said guide means including a pair of spaced guide flanges; said guide flanges and a surface of the guide means therebetween defining a recess for aligning cards received in said recess on said elevator means;

said guide flanges including beveled edges engageable by cards being moved onto said elevator means by an associated one of said pusher means for displacing the guide flange beveled edge engaged by cards being moved onto the elevator means by one of said pusher means, away from the path of movement of the cards while the remaining flange engages the cards pushed onto the elevator means to limit movement of the cards, thereby aligning the cards on the elevator means delivered by a pusher means.

11. The apparatus of claim 10 wherein said guide means comprise a pair of substantially flat members arranged in side-by-side fashion and substantially parallel to the path of movement of the pusher means with side edges of each member being adjacent one another and said members lying in a common plane;

pivot means pivotally mounting said adjacent side edges;

the planar members being arranged on one side of the elevator means; and the free ends of the planar members having flanges extending toward said elevator means, said flanges and the surfaces of the planar members facing the elevator means defining said recess for receiving and aligning a pack of cards entering said recess.

12. The apparatus of claim 11 further comprising bias means normally urging the flange ends of the planar members towards said elevator means and being yieldable to permit displacement of the flange ends of said planar members out of the path of movement of cards being pushed toward the elevator means by said pusher means.

13. The apparatus of claim 11 wherein said planar members are arranged within an opening in a vertical wall forming one side of the card shuffling and cutting apparatus;

each of said planar members having top and bottom edges each of said edges having portions thereof projecting into recesses in said opening of a shape conforming to said projections to prevent cards from being wedged into the gap space between the top and bottom edges of said planar members and the portions of the opening adjacent said top and bottom edges.

14. The apparatus of claim 9 further comprising spring loaded guide means arranged adjacent to said elevator means and having guide edges extending into the path of movement of cards pushed onto the elevator means by said pusher means for preventing cards delivered to said card receiving regions by said rollers from advancing to said elevator means and being yieldable to be displaced from said path when a stack of cards is pushed toward said elevator means by a pusher means.

15. The apparatus of claim 14 wherein said guide edges are bevelled to align the stack of cards being collected in its associated card receiving region and for aligning cards as they are being pushed onto the elevator means by an associated pusher means.

16. The apparatus of claim 9 wherein said card receiving regions are each provided with a vertical back wall and an inclined surface for supporting cards collected upon said surface to urge the cards toward said back wall to align the cards preparatory to being pushed upon said elevator means.

17. The shuffling apparatus of claim 8 wherein said first pusher means is further comprised of sensor means for sensing the effective top of the elevator means to generate an initiate pusher means signal, said effective top being the top surface of the elevator means when there are no playing cards on the elevator means, or the top surface of the top playing card is resting upon said elevator means.

18. Shuffling apparatus for playing cards comprising:

a housing;

shuffling means in said housing;

elevator means in said housing for delivering playing cards to said shuffling means;

a closure member movable between a first position unsealing an opening in said housing and a second position sealing said opening;

said elevator means being positioned adjacent to said opening;

playing card transfer means positioned adjacent to said housing and including a playing card holder movable from a first position outside of said housing and through said opening to a second position inside said housing and above said elevator means;

means responsive to the deposit of playing cards upon said holder for moving said closure member to said first position;

means responsive to movement of said closure member to said first position for moving said holder to said second position and thereafter to said first position causing playing cards on said holder to be transferred to said elevator means;

means responsive to movement of said holder to said first position for moving said closure means to said second position; and means responsive to movement of said closure means to said second position for moving said elevator means to deliver the playing cards on said elevator means to said shuffling means.

19. The apparatus of claim 18 further comprising manually operable start means operable by an operator for placement of a stack of cards on said holder;

said means responsive to the deposit of cards on said holder further including means responsive to operation of said start switch means to move said closure member to said first position.

20. The apparatus of claim 18 wherein said transfer means is provided with a surface for receiving a stack of cards, said surface having a plurality of spaced grooves, said holder having a plurality of spaced projections each adapted to be sidably received in a respective one of said grooves to guide the movement of said holder and to prevent cards from being wedged between said holder and said receiving surface.

21. Apparatus for delivering playing cards to a card dealing shoe having a diagonally aligned hollow card chute, with a rear open end for receiving playing cards, and delivering to the playing cards a forward card dispensing end, comprising:

shuffling means for shuffling said playing cards;

elevator means for supporting a stack of shuffled playing cards received from said shuffling means in a horizontal position;

means for moving said elevator means in a downward direction;

means for tilting said stack of playing cards to assume a diagonal orientation from said horizontal position as the elevator means passes a predetermined location;

swingable guide means swingable about pivot means from a first substantially vertical position to a second diagonally aligned position whereby the free end of said swingable guide means moves from a position substantially vertically above said pivot means to a second position adjacent the open rear end of said chute;

said swingable guide means having a guide surface extending diagonally downwardly from said tilting means toward said chute open rear end to whereby the stack of playing cards tilted by said tilting means slides along said guide surface diagonally downwardly and on to said chute through said rear open end.

22. The apparatus of claim 21 further comprising:

substantially planar separator means arranged in a diagonally aligned manner at a first position a spaced distance from said forward card delivery end for separating playing cards guided toward said rear open end from between said delivery end and said separator means;

means for moving said separator means from its first position to a second position closer to the rear open end of said chute to cause all of the playing cards in said chute to be positioned between said separator means and said card delivery end.

23. The apparatus of claim 22 further comprising means for urging said separator means toward said delivery end to maintain advancement of said cards toward said forward card dispensing end.

24. The apparatus of claim 22 further comprising means for lifting said separator means above the cards in said chute and placing said separator means behind the last card delivered to said card chute.

25. The apparatus of claim 22 further comprising means for moving said separator means in an abrupt manner through a small distance in the direction in which the cards are moved toward said forward card dispensing end to jog said cards.

26. The apparatus of claim 22 further comprising means for moving said tilting means toward said card shoe for advancing the tilted cards into said chute.

27. Apparatus for delivering cards from a receiving station to a card shoe comprising:

guide means having a diagonally aligned guiding surface for moving cards from said card receiving means toward said card shoe, the region behind the card shoe being a card receiving region;

tilt means at the upper end of said guide means for tilting the cards from a horizontal orientation to a diagonal orientation as cards are lowered onto said guide means;

means for moving said tilt means to push said tilted cards along said guide means and into said card receiving region said shoe;

paddle means including a paddle for resting against the cards when in the card receiving region;

said paddle means further including means for lifting said paddle upwardly and away from said card receiving region when moved in a first direction and downwardly and into the card receiving region cards when moved in a second direction;

means for moving said paddle means in a rearward direction away from said card shoe and a forward direction toward said card shoe;

control means for operating said moving means to move said paddle means upwardly and away from said guide means as cards are being pushed on said guide means by said tilting means; and said control means further comprising operating said moving means for lowering said paddle toward said guide means and for moving said paddle means in a forward direction toward said shoe to maintain the cards pushed into said card shoe in close engagement.

28. The apparatus of claim 27 further comprising means for reciprocating said paddle means in a forward and rearward direction through a small distance and at spaced time intervals for maintaining said cards in alignment in the card shoe.

29. A method for shuffling and cutting cards comprising the steps of:

(a) providing a card receiving station, movable elevator means and a movable door arranged between said card receiving station and said elevator means;

(b) providing a pusher for pushing cards deposited on the card receiving station towards said elevator means;

(c) opening said door when said pusher is in a position displaced from the card receiving station to permit cards to be placed thereon;

(d) lifting the elevator means so that it is substantially aligned with said card receiving station in order to enable cards to be pushed directly onto the elevator means;

(e) lowering the elevator means by an amount sufficient to align the cards deposited thereon with the card receiving station to receive a subsequent stack of cards;

(f) closing the door;

(g) moving the elevator means upwardly toward shuffling means comprised of a pair of rollers;

(h) rotating said rollers and reciprocating the pair of rotating rollers in a direction transverse to the direction of movement of the elevator means causing cards engaging said rollers to be advanced in a leftward and rightward direction on opposite sides of the elevator means toward card receiving locations, said cards being removed from said stack by said roller means in a random fashion;

(i) lowering the elevator means to a position to receive cards arranged in said lefthand and righthand card receiving regions; and (j) pushing the cards from said card receiving regions onto said elevator means in a random fashion.

30. The method of claim 29 further comprising repeating steps (a) to (j) in order to shuffle and cut the cards N times wherein N is a real integer greater than 1.

31. The method of claim 29 further comprising the steps of providing a hollow card dealing shoe;

moving the elevator means downwardly to a dispensing location; and moving the cards from the dispensing location into said card shoe.

32. The method of claim 31 wherein the step of moving the cards from the dispensing location into the card shoe further comprises the steps of arranging guides between the card dispensing location and the rear of the card shoe;

tilting the cards delivered to the dispensing location by the elevator means to a diagonal orientation; and pushing the diagonally aligned group of cards along said guide means and into said card shoe.

33. The method of claim 32 further comprising the steps of providing a plate for resting against the cards in the card shoe responsive to the delivery of cards to the card shoe;

lifting the plate upwardly and away from the cards within the card shoe preparatory to the delivery of cards to the card shoe along said guide means;

moving the plate in a direction away from the rearward end of the card shoe;

lowering the plate; and thereafter moving the plate toward said card shoe into engagement with the last card delivered thereto along said guide means.

34. The method of claim 33 comprising the step of moving said plate in a reciprocating manner away from and toward the card shoe to push against the card into the card shoe and maintain proper alignment thereof.

35. A method for shuffling and cutting cards through the utilization of a movable elevator means, a roller assembly including a pair of rollers and pusher means for cutting cards, said method comprising the steps of:

(a) aligning the elevator means with a card loading station for receiving cards;

(b) lowering the elevator means upon receipt of the cards so that the top of the stack of cards is aligned with the card receiving means;

(c) moving the elevator means a fixed distance at a first high speed rate upwardly toward said roller means which are arrange at a spaced distance above the height of the card receiving location to move the top of the stack of cards just below the roller means;

(d) reducing the rate of movement of said elevator means when said elevator means has moved said fixed distance; and (e) rotating said rollers in first and second opposing directions and reciprocating the roller assembly back-and-forth along a path which is transverse to the longitudinal axis of the elevator means for delivering cards to the left and to the right of said elevator means and into said first and second card receiving regions whereby the number of cards delivered in the leftward and rightward direction and the order of delivery is random.

36. The method of claim 35 further comprising the steps of:

providing pushers at the lower end of each of the card receiving regions;

lowering the elevator means responsive to the movement of all of the cards off of the elevator means by said roller means to a height to place the elevator means into alignment with said pushers;

randomly selecting one of said pushers for pushing the cards in its associated card receiving region onto said elevator means;

lowering said elevator means to place the top of the cards delivered thereon into alignment with the height of the remaining pusher; and operating the remaining pusher to push the stack of the cards in its associated card receiving region onto said elevator means.

37. The method of claim 36 further comprising the step of:

providing a dealing shoe for receiving cards which have been shuffled and cut;

providing a tilting means with a diagonally aligned upper surface;

lowering the elevator means to lower the cards thereon upon the diagonally aligned upper surface to move the cards from a horizontal alignment to a diagonal alignment;

providing a diagonally aligned guide surface between the dealing shoe and the tilting means; and moving the tilting means for pushing the diagonally oriented cards along the guide surface and into the dealing shoe.

* * * * *